US009422717B2

(12) United States Patent
Tanaka et al.

(10) Patent No.: US 9,422,717 B2
(45) Date of Patent: Aug. 23, 2016

(54) COLUMN STRUCTURE AND BASE MEMBER

(71) Applicant: Senqcia Corporation

(72) Inventors: Hidenori Tanaka, Tokyo (JP); Hideaki Takahashi, Tokyo (JP)

(73) Assignee: Senqcia Corporation, Tokyo (JP)

( * ) Notice: Subject to any disclaimer, the term of this patent is extended or adjusted under 35 U.S.C. 154(b) by 0 days.

(21) Appl. No.: 14/345,949

(22) PCT Filed: Mar. 17, 2014

(86) PCT No.: PCT/JP2014/057082

§ 371 (c)(1),
(2) Date: Mar. 20, 2014

(87) PCT Pub. No.: WO2015/140892

PCT Pub. Date: Sep. 24, 2015

(65) Prior Publication Data

US 2015/0259916 A1 Sep. 17, 2015

(51) Int. Cl.

| | |
|---|---|
| ***E04C 3/32*** | (2006.01) |
| ***E04C 2/08*** | (2006.01) |
| ***E04B 1/41*** | (2006.01) |
| ***E04B 1/24*** | (2006.01) |

(52) U.S. Cl.

CPC ... *E04C 3/32* (2013.01); *E04B 1/24* (2013.01); *E04B 1/4157* (2013.01); *E04B 2001/2463* (2013.01)

(58) Field of Classification Search

CPC ..... E04C 3/32; E04C 2/08; E04B 1/4157; E04B 2103/06

See application file for complete search history.

(56) References Cited

U.S. PATENT DOCUMENTS

| | | | | |
|---|---|---|---|---|
| 1,355,536 | A | | 10/1920 | Casikey |
| 1,530,951 | A | | 3/1925 | Krauss |
| 2,610,708 | A | * | 9/1952 | Harold ..... 52/296 |
| 2,943,716 | A | | 7/1960 | Babcock et al. |
| 3,918,229 | A | | 11/1975 | Schweinberger |
| 4,048,776 | A | | 9/1977 | Sato |
| 4,136,811 | A | | 1/1979 | Sato |
| 4,571,913 | A | | 2/1986 | Schleich |

(Continued)

FOREIGN PATENT DOCUMENTS

| | | |
|---|---|---|
| CN | 203188470 U | 9/2013 |
| CN | 203452266 | 2/2014 |

(Continued)

OTHER PUBLICATIONS

Japanese Office Action dated May 19, 2015 in Japanese Patent Application No. 2014-513826.

(Continued)

*Primary Examiner* — Mark Wendell
*Assistant Examiner* — Keith Minter
(74) *Attorney, Agent, or Firm* — Solaris Intellectual Property Group, PLLC

(57) ABSTRACT

In a column structure, a steel column serving as a column member is joined to a base plate serving as a base member. The steel column is configured by a pair of flanges provided at each of two width direction ends of a web. One end side of the base plate is fixed by first anchor members. The other end side of the base plate is fixed by second anchor members, and the second anchor members are formed with higher tensile strength than the first anchor members.

15 Claims, 11 Drawing Sheets

(56) References Cited

U.S. PATENT DOCUMENTS

| | | | | |
|---|---|---|---|---|
| 4,878,160 | A | 10/1989 | Reneau | |
| 4,965,974 | A * | 10/1990 | LeBow | 52/301 |
| 5,054,251 | A | 10/1991 | Kemeny | |
| 5,063,719 | A * | 11/1991 | Matsuo et al. | 52/296 |
| 5,274,971 | A | 1/1994 | Elmore et al. | |
| 5,307,603 | A | 5/1994 | Chiodo | |
| 5,410,847 | A * | 5/1995 | Okawa et al. | 52/272 |
| 5,412,913 | A | 5/1995 | Daniels | |
| 5,426,267 | A * | 6/1995 | Underhill et al. | 181/210 |
| 5,444,951 | A | 8/1995 | Scott et al. | |
| 5,467,567 | A | 11/1995 | Christensen | |
| 5,505,033 | A | 4/1996 | Matsuo et al. | |
| 5,540,027 | A | 7/1996 | Christensen | |
| 5,678,382 | A | 10/1997 | Naito | |
| 6,219,989 | B1 | 4/2001 | Tumura | |
| 6,367,762 | B1 | 4/2002 | Koban | |
| 6,438,904 | B1 | 8/2002 | Anzai | |
| 6,754,999 | B1 | 6/2004 | Urbanczyk | |
| 6,931,804 | B2 | 8/2005 | Trarup et al. | |
| 7,647,742 | B2 | 1/2010 | Han | |
| 8,011,156 | B1 | 9/2011 | Schwan | |
| 8,037,651 | B2 | 10/2011 | Dent | |
| 8,336,267 | B2 | 12/2012 | Montague | |
| 8,850,765 | B2 | 10/2014 | Amengual Pericas | |
| 8,955,283 | B2 | 2/2015 | Takagi et al. | |
| 2002/0002806 | A1 | 1/2002 | Commins et al. | |
| 2002/0066245 | A1 | 6/2002 | Pryor | |
| 2002/0095275 | A1 | 7/2002 | Anzai et al. | |
| 2003/0009964 | A1 | 1/2003 | Trarup et al. | |
| 2003/0196393 | A1 | 10/2003 | Bowman et al. | |
| 2004/0040224 | A1 | 3/2004 | Dayton | |
| 2004/0148903 | A1 | 8/2004 | Cash | |
| 2005/0120666 | A1 | 6/2005 | Alyea et al. | |
| 2006/0048471 | A1 | 3/2006 | Lee | |
| 2007/0209314 | A1 * | 9/2007 | Vaughn | 52/720.1 |
| 2007/0245674 | A1 | 10/2007 | Hubbell | |
| 2009/0272053 | A1 | 11/2009 | Dent | |
| 2009/0279959 | A1 | 11/2009 | Bakos | |
| 2010/0146890 | A1 | 6/2010 | Kristensen | |
| 2011/0154758 | A1 | 6/2011 | Reyneveld | |
| 2012/0186168 | A1 | 7/2012 | McPhee | |
| 2014/0069046 | A1 | 3/2014 | Cai | |
| 2014/0230365 | A1 | 8/2014 | Hemphill | |
| 2014/0318033 | A1 | 10/2014 | Coordes | |
| 2015/0082719 | A1 * | 3/2015 | Takahashi | E04B 1/40 52/298 |
| 2015/0191929 | A1 * | 7/2015 | Takahashi | E02D 27/42 52/295 |

FOREIGN PATENT DOCUMENTS

| | | | |
|---|---|---|---|
| CN | 203531147 | | 4/2014 |
| JP | H02-213540 | | 8/1990 |
| JP | H04-052320 | | 2/1992 |
| JP | H04-153427 | | 5/1992 |
| JP | H05-214731 | | 8/1993 |
| JP | H06-010408 | | 1/1994 |
| JP | H06-010410 | | 1/1994 |
| JP | H06-019147 | | 1/1994 |
| JP | H06-019147 | B2 | 3/1994 |
| JP | 2655774 | | 9/1997 |
| JP | H09-264029 | | 10/1997 |
| JP | H10-008555 | | 1/1998 |
| JP | H11-286945 | A | 10/1999 |
| JP | 2000240167 | A * | 9/2000 |
| JP | 2001-288815 | | 10/2001 |
| JP | 2002-146923 | | 5/2002 |
| JP | 2002-322737 | | 11/2002 |
| JP | 2002-339455 | | 11/2002 |
| JP | 2002-364070 | | 12/2002 |
| JP | 2003-232078 | | 8/2003 |
| JP | 2003-239381 | | 8/2003 |
| JP | 2003232078 | A * | 8/2003 |
| JP | 2004-176482 | | 6/2004 |
| JP | 2005-16212 | A | 1/2005 |
| JP | 2005061088 | A * | 3/2005 |
| JP | 2005344289 | A * | 12/2005 |
| JP | 2006-125157 | | 5/2006 |
| JP | 2008-144425 | | 6/2008 |
| JP | 2008-280787 | | 11/2008 |
| JP | 2009-024367 | | 2/2009 |
| JP | 2009-062717 | | 3/2009 |
| JP | 2009-256885 | | 11/2009 |
| JP | 2009-275390 | | 11/2009 |
| JP | 4570139 | | 10/2010 |
| JP | 2011-012402 | | 1/2011 |
| JP | 2011-247077 | | 12/2011 |
| JP | 2012-007382 | | 1/2012 |
| JP | 2013-64244 | | 4/2013 |
| JP | 2013-100673 | | 5/2013 |
| JP | H05-346038 | | 11/2013 |
| TW | 174024 | | 12/1991 |
| TW | 541388 | B | 7/2003 |

OTHER PUBLICATIONS

Japanese Office Action dated May 19, 2015 in Japanese Patent Application No. 2014-513827.

U.S Office Action dated Feb. 24, 2015, issued against U.S. Appl. No. 14/345,946.

U.S Office Action dated May 7, 2015, issued against U.S. Appl. No. 14/345,947.

Japanese Office Action dated May 19, 2015 in Japanese Patent Application No. 2014-513828.

U.S. Office Action dated Aug. 21, 2015 issued against U.S. Appl. No. 14/345,946.

English Translation of the Taiwanese Office Action dated Aug. 26, 2015 in the corresponding Taiwanese Patent Application No. 103109925. This office action translation is submitted now in order to supplement the understanding of the cited references which are being disclosed in the instant Information Disclosure Statement.

Final Office Action dated Oct. 8, 2015, issued for the U.S. Appl. No. 14/345,947.

Office Action dated Oct. 21, 2015, issued for the U.S. Appl. No. 14/345,951.

Office Action dated Feb. 5, 2016, issued for the U.S. Appl. No. 14/345,947.

* cited by examiner

COLUMN STRUCTURE AND BASE MEMBER

TECHNICAL FIELD

The present invention relates to a column structure with a column member joined to the upper side of a base member, and to a base member that has an upper side for joining to a column member.

BACKGROUND ART

Japanese Patent Application Publication (JP-B) No. H6-19147 discloses a column base structure. In this column base structure, a base plate is joined to anchor bolts that are buried in a concrete foundation. A column is joined to the base plate, and the center of a projected outline of the column with respect to the horizontal plane is offset with respect to the center of a projected outline of the base plate with respect to the horizontal plane. In this column base structure, an out-of-plane deformation prevention means is provided to the base plate on the opposite side to the side to which the column is offset. The out-of-plane deformation prevention means is configured by washers, anchor bolts, or ribs. When bending moment arises in the column, the out-of-plane deformation prevention means prevents the base plate from undergoing out-of-plane deformation so as to deform such that the upper face projects out.

In the above column base structure, the column is offset and joined to the base plate, necessitating the out-of-plane deformation prevention means. The column base structure becomes more complicated as a result, leaving room for improvement.

DISCLOSURE OF INVENTION

Technical Problem

In consideration of the above circumstances, an object of the present invention is to obtain a column structure and a base member capable of raising column seat bending strength with a simple configuration.

Solution to Problem

A column structure of a first aspect of the present invention includes: a column member that is integrally provided with a flange at each of two width direction sides of a web; a base member that has the column member joined to an upper side of the base member; a first anchor member including a lower end side that is fixed to a foundation, and including an upper end side to which the base member is fixed at one width direction end side of the web, or at one width direction end side of the flange; and a second anchor member including a lower end side that is fixed to the foundation, and including an upper end side to which the base member is fixed at the other width direction end side of the web, or at the other width direction end side of the flange, the second anchor member having higher tensile strength than the first anchor member.

A column structure of a second aspect of the present invention is the column structure of the first aspect, wherein a shaft diameter of the second anchor member is formed larger than a shaft diameter of the first anchor member.

A column structure of a third aspect of the present invention is the column structure of the first aspect, wherein the second anchor member is formed from a material with higher tensile strength than the first anchor member material.

A column structure of a fourth aspect of the present invention is the column structure of the first aspect, wherein there are a greater number of the second anchor member formed than that of the first anchor member.

A column structure of a fifth aspect of the present invention is the column structure of the first aspect, wherein the first anchor member or the second anchor member includes: a first anchor bolt including an upper end side to which the base member is fixed at the opposite side of the flange to the web side; and a second anchor bolt including an upper end side to which the base member is fixed further toward the web width direction inside than the first anchor bolt, and that is disposed closer to the flange than the first anchor bolt.

A column structure of a sixth aspect of the present invention is the column structure of the first aspect, wherein the first anchor member is disposed at the inside of a building, and the second anchor member is disposed at the outside of the building.

A column structure of a seventh aspect of the present invention includes: a column member that is integrally provided with a flange at each of two width direction sides of a web; a base member that has the column member joined to an upper side of the base member, with a center position of the column member offset in the web width direction, or in the flange width direction, with respect to a center position of the base member; a first anchor member including a lower end side that is fixed to a foundation, and including an upper end side to which the base member is fixed at one width direction end side of the web; and a second anchor member including a lower end side that is fixed to the foundation, and including an upper end side to which the base member is fixed at the other width direction end side of the web, or at the other width direction end side the flange, the second anchor member having equivalent tensile strength to the first anchor member.

A column structure of an eighth aspect of the present invention is the column structure of the seventh aspect, wherein: the first anchor member upper end side is fixed to the base member at the opposite side of the flange to the web side, and the second anchor member upper end side is fixed to the base member at the web side of the flange.

A column structure of a ninth aspect of the present invention is the column structure of either the first aspect or the seventh aspect, wherein the base member includes a cutaway portion including a portion along the web that is cut away.

A column structure of a tenth aspect of the present invention is the column structure of either the first aspect or the seventh aspect, wherein the base member includes: a first base member that has one of the flanges joined to an upper side of the first base member, and that has the first anchor member upper end side fixed to the first base member; and a second base member that has the other of the flanges joined to an upper side of the second base member, and that has the second anchor member upper end side fixed to the second base member, with the second base member provided at a separation to the first base member.

A base member of an eleventh aspect of the present invention includes: a base body that has an upper side for joining to a column member integrally provided with a flange at each of two width direction sides of a web; a first fixing portion that is fixed to an upper end side of a first anchor member, the first anchor member being provided to the base body at one width direction end side of the web, or at one width direction end side of the flange, and including a lower end side that is fixed to a foundation; and a second fixing portion that is fixed to an upper end side of a second anchor member, the second anchor member being provided to the base body at the other width direction end side of the web, or at the other width direction end side of the flange, including a lower end side that is fixed to the foundation, and having higher tensile strength than the first anchor member.

A base member of a twelfth aspect of the present invention includes: a base body that has an upper side for joining to a column member integrally provided with a flange at each of two width direction sides of a web, with a center position of the column member offset in the web width direction, or in the flange width direction; a first fixing portion that is fixed to an upper end side of a first anchor member, the first anchor member being provided to one web width direction end side of the base body and including a lower end side that is fixed to a foundation; a second fixing portion that is fixed to an upper end side of a second anchor member, the second anchor member being provided to the web width direction other end side of the base body and including a lower end side that is fixed to the foundation, and having equivalent tensile strength to the first anchor member.

A base member of a thirteenth aspect of the present invention is the base member of either the eleventh aspect or the twelfth aspect, wherein the base body includes a cutaway portion including a portion along the web that is cut away.

A base member of a fourteenth aspect of the present invention is the base member of either the eleventh aspect or the twelfth aspect, wherein the base body includes: a first base body that has one of the flanges joined to an upper side of the first base body, and that has the first anchor member upper end side fixed to the first base body; and a second base body that has the other of the flanges joined to an upper side of the second base body, and that has the second anchor member upper end side fixed to the second base body, with the second base body provided at a separation to the first base body.

Advantageous Effects of Invention

In the column structure of the first aspect of the present invention, the column member that is integrally provided with the flanges at each of two width direction sides of the web is joined to the upper side of the base member. The lower end sides of the first anchor member and the second anchor member are fixed to the foundation, and the base member is fixed to the upper end sides of the first anchor member and the second anchor member.

The upper end side of the first anchor member is fixed to the base member at one width direction end side of the web, or at one width direction end side of the flange. The upper end side of the second anchor member is fixed to the base member at the other width direction end side of the web, or at the other width direction end side of the flange, and the tensile strength of the second anchor member is higher than the tensile strength of the first anchor member. For example, when horizontal direction force acts on the column member from the other end side toward the one end side of the base member, a larger vertical direction tensile axial force arises at the other end side of the base member than at the one end side of the base member. Such a large tensile axial force is effectively suppressed by the second anchor member that has higher tensile strength. The column seat bending strength of the column structure can accordingly be raised by the simple configuration in which the tensile strength of the second anchor member is raised.

In the column structure of the second aspect of the present invention, the shaft diameter of the second anchor member is formed larger than the shaft diameter of the first anchor member. The tensile strength of the second anchor member can accordingly be raised, and the column seat bending strength of the column structure can be raised, by the simple configuration in which the shaft diameter is increased.

In the column structure of the third aspect of the present invention, the second anchor member is formed from a material with higher tensile strength than the first anchor member material. The tensile strength of the second anchor member can accordingly be raised, and the column seat bending strength of the column structure can be raised, by the simple configuration in which a material with higher tensile strength is employed.

In the column structure of the fourth aspect of the present invention, there is a greater number of the second anchor member formed than that of the first anchor member. The tensile strength of the second anchor member can accordingly be raised, and the column seat bending strength of the column structure can be raised, by the simple configuration in which the number of the second anchor member is increased.

In the column structure of the fifth aspect of the present invention, the first anchor member or the second anchor member includes the first anchor bolt and the second anchor bolt. The upper end side of the first anchor bolt is fixed to the base member at the opposite side of the flange to the web side. The upper end side of the second anchor bolt is fixed to the base member further toward the web width direction inside than the first anchor bolt. Since the second anchor bolt is disposed closer to the flange than the first anchor bolt, the distance between the column member and the second anchor bolt is reduced. The thickness of the base member is determined by the tensile strength of the second anchor bolt and the distance between the second anchor bolt and the column member. The thickness of the base member can accordingly be reduced due to reducing the distance between the second anchor bolt and the column member.

In the column structure of the sixth aspect of the present invention, the first anchor bolt is disposed at the inside of the building, and the second anchor member is disposed at the outside of the building. For example, when horizontal direction force acts on the column member from the building outside toward the building inside, a larger vertical direction tensile axial force arises in the second anchor member that is at the building outside. Such a large tensile axial force is effectively suppressed by the second anchor member that has high tensile strength. The column seat bending strength of the column structure can accordingly be raised by the simple configuration in which the strength of the second anchor member is raised.

In the column structure of the seventh aspect of the present invention, the column member that is integrally provided with the flange at each of two width direction sides of the web is joined to the upper side of the base member. The lower end sides of the first anchor member and the second anchor member are fixed to the foundation, and the base member is fixed to the upper end sides of the first anchor member and the second anchor member.

The first anchor member and the second anchor member have equivalent tensile strength to one another, the upper end side of the first anchor member is fixed to the one end side of the base member, and the upper end side of the second anchor member is fixed to the other end side of the base member. The center position of the column member is offset in the web width direction, or in the flange width direction, thereby reinforcing the base member with the column member at the offset location of the column member. For example, when horizontal direction force acts on the column member from the opposite side to the offset direction of the column member, a large vertical direction tensile axial force arises in the column member at the base member at the column member offset location. Such a large tensile axial force is effectively suppressed by the reinforced location of the base member where the column member is offset. The column seat bending strength of the column structure can accordingly be raised by the simple configuration in which the column member is offset and joined to the base member.

In the column structure of the eighth aspect of the present invention the second anchor member upper end side is fixed to the base member at the web side of the flange, thereby enabling a location on the opposite side of the flange to the web side to be omitted at the other end side of the base member. The center position of the column member can accordingly be simply offset with respect to the center position of the base member, since the center position of the base member is moved toward the one end side of the base member with respect to the center position of the column member.

The column member of the ninth aspect of the present invention the base member includes the cutaway portion, thereby enabling a location of the base member corresponding to the cutaway to be omitted, enabling a reduction in weight of the base member.

In the column structure of the tenth aspect of the present invention, the base member includes the first base member that is joined to one of the flanges and the second base member that is joined to the other of the flanges, and the first base member and the second base member are at a separation to each other. A location of the base member between the first base member and the second base member can accordingly be omitted, reducing the weight of the base member.

In the base member of the eleventh aspect of the present invention the column member that is integrally provided with the flange at each of two width direction sides of the web is joined to the upper side of the base body. The lower end sides of the first anchor member and the second anchor member are fixed to the foundation, and the upper end side of the first anchor member is fixed to the first fixing portion of the base body, and the upper end side of the second anchor member is fixed to the second fixing portion of the base body.

The upper end side of the first anchor member is fixed to the first fixing portion at one width direction end side of the web, or at one width direction end side of the flange. The upper end side of the second anchor member is fixed to the second fixing portion of the base body at the web other width direction end side, or at the flange other width direction end side, and the tensile strength of the second anchor member is higher than the tensile strength of the first anchor member. For example, when horizontal direction force acts on the column member from the other end side toward the one end side of the base body, a larger vertical direction tensile axial force arises on the column member at the other end side than at the one end side of the base body. Such a large tensile axial force is effectively suppressed by the second anchor member that is fixed to the second fixing portion and has high tensile strength. The column seat bending strength of a column structure can accordingly be raised by the simple configuration in which the second anchor member with high tensile strength is fixed to the second fixing portion of the base body.

In the base member of the twelfth aspect of the present invention, the column member that is integrally provided with the flanges at each of two width direction sides of the web is joined to the upper side of the base body. The lower end sides of the first anchor member and the second anchor member are fixed to the foundation, and the upper end side of the first anchor member is fixed to the first fixing portion of the base body, and the upper end side of the second anchor member is fixed to the second fixing portion of the base body.

The first anchor member and the second anchor member have equivalent tensile strength to one another, the upper end side of the first anchor member is fixed to the first fixing portion of the base body, and the upper end side of the second anchor member is fixed to the second fixing portion of the base body. The center position of the column member is offset in the web width direction, or in the flange width direction, and the base body is reinforced by the column member at the offset location of the column member. For example, when horizontal direction force acts on the column member from the opposite side to the offset direction of the column member, a large vertical direction tensile axial force arises on the column member at the base body at the offset location of the column member. Such a large tensile axial force is effectively suppressed by the location of the base body reinforced by the offset column member. The column seat bending strength of the column structure can accordingly be raised by the simple configuration in which the column member is joined to the base body at an offset.

In the base member of the thirteenth aspect of the present invention, the base body includes the cutaway portion, thereby enabling a location of the base body corresponding to the cutaway to be omitted, and reducing the weight of the base body.

In the base member of the fourteenth aspect of the present invention, the base body includes the first base body that is joined to the one of the flanges, and the second base body that is joined to the other of the flanges. The first base body and the second base body are disposed at a separation to each other. A location of the base member between the first base body and the second base body can accordingly be omitted, reducing the weight of the base member.

BEST MODE FOR CARRYING OUT THE INVENTION

First Exemplary Embodiment

Figure 1:
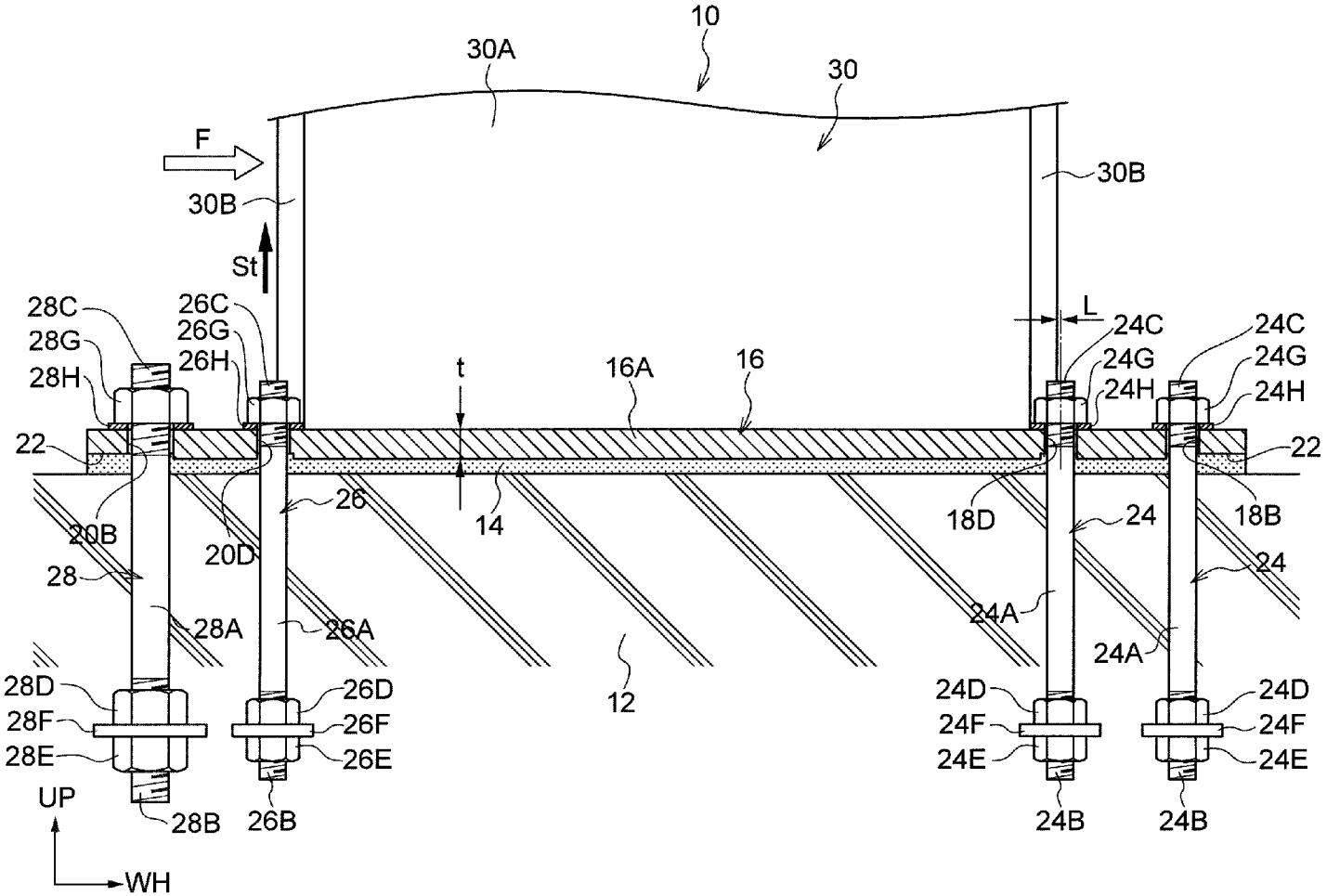
FIG. 1 is a cross-section of a column structure and base member according to a first exemplary embodiment of the present invention, as viewed along a flange width direction (taken along line A-A in FIG. 2).

Explanation follows regarding a column structure and a base member according to a first exemplary embodiment of the present invention, with reference to FIG. 1 to FIG. 5. Note that in the present exemplary embodiment an H-section structural steel column (H-section steel column) is employed as a column member, and in the drawings the arrow WH direction indicates a width direction of a web of the column member, and the arrow FH direction indicates a width direction of flanges of the column member as appropriate. The arrow UP direction indicates upwards.

Column Structure and Base Member Configuration

Figure 2:
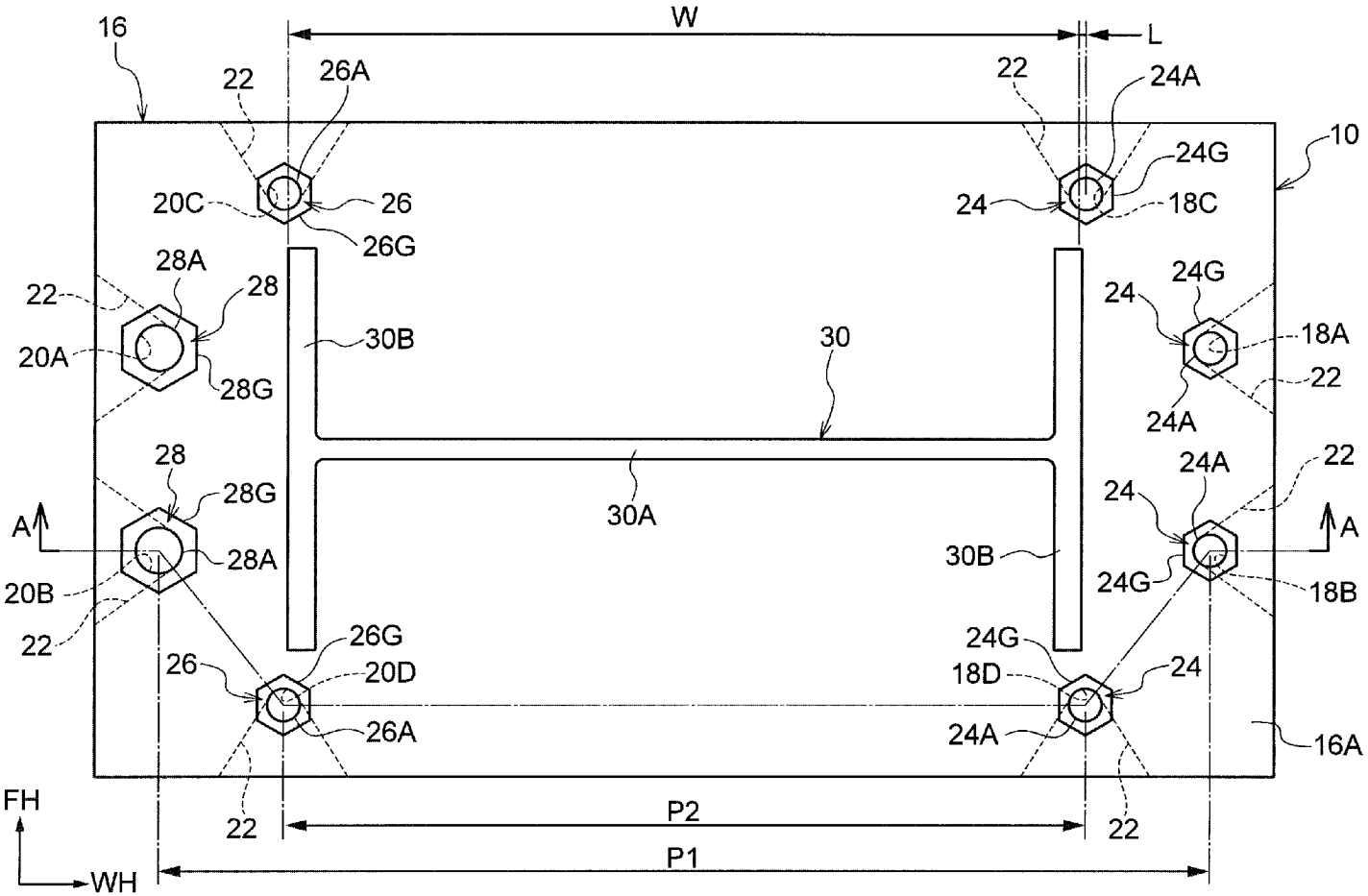
FIG. 2 is a plan view of a column structure and a base member according to the first exemplary embodiment of the present invention.

As illustrated in FIG. 1 and FIG. 2, a column structure 10 according to the present exemplary embodiment is placed on a foundation 12. The foundation 12 is, for example, concrete, and an upper face of the foundation 12 is formed as a horizontal and flat plane shape. Although not illustrated in the drawings, reinforcement is laid inside the foundation 12, raising the strength of the foundation 12.

Mortar 14 is provided as a fixing member on the upper surface of the foundation 12. The mortar 14 is formed, for example, in a rectangular shape in plan view.

A base member 16 is fixed to an upper face of the mortar 14. The base member 16 is provided with a base plate 16A, as a base body. The mortar 14 is disposed across the entire lower side of the base plate 16A. The base plate 16A is configured in a rectangular flat plate shape with its length direction along the arrow WH direction and its short direction along the arrow FH direction. More specifically, the base plate 16A is formed from a metal material, for example SN490B hot-rolled structural steel plate for construction according to Japanese Industrial Standard (JIS) specification G3136, or cast steel.

Two first fixing holes, a first fixing hole 18A, a first fixing hole 18B, and two second fixing holes, a second fixing hole 18C and a second fixing hole 18D are provided as first fixing portions at one length direction end portion of the base plate 16A, illustrated on the right hand side in FIG. 1 and FIG. 2. The first fixing hole 18A and the first fixing hole 18B are provided at intermediate portions in the base plate 16A short direction. The second fixing hole 18C and the second fixing hole 18D are provided at both end portions in the base plate 16A short direction. The first fixing hole 18A, the first fixing hole 18B, the second fixing hole 18C and the second fixing hole 18D are formed as circular shaped through holes having the same diameter in plan view.

The position of the center axis of the first fixing hole 18A and the position of the center axis of the first fixing hole 18B are aligned with each other along the arrow FH direction. The position of the center axis of the second fixing hole 18C and the position of the center axis of the second fixing hole 18D are aligned with each other along the arrow FH direction. In addition, the positions of the center axes of the second fixing hole 18C and the second fixing hole 18D are configured more toward a length direction central portion of the base plate 16A so as to be further toward the arrow WH direction inside than the positions of the center axes of the first fixing hole 18A and the first fixing hole 18B. Moreover, the position of the center axis of the second fixing hole 18C is further to the arrow FH outside than the position of the center axis of the first fixing hole 18A. The position of the center axis of the second fixing hole 18D is further to the arrow FH direction outside than the position of the center axis of the first fixing hole 18B.

The other length direction end portion of the base plate 16A illustrated on the left hand side in FIG. 1 and FIG. 2 is provided with two first fixing holes, a first fixing hole 20A and a first fixing hole 20B and two second fixing holes, a second fixing hole 20C and a second fixing hole 20D, respectively serving as second fixing portions. The first fixing hole 20A and the first fixing hole 20B are provided at a short direction intermediate portion of the base plate 16A. The second fixing hole 20C and the second fixing hole 20D are provided at both end portions in the base plate 16A short direction. The second fixing hole 20C and the second fixing hole 20D are formed as circular shaped through holes having the same diameter in plan view, and are configured with the same diameter as the first fixing holes 18A to 18D. The first fixing hole 20A and the first fixing hole 20B are formed as circular shaped through holes having the same diameter in plan view, and are configured with a larger diameter than the second fixing hole 20C and the second fixing hole 20D in the present exemplary embodiment. In other words, the diameters of the first fixing hole 20A and the first fixing hole 20B are formed larger than the diameters of the second fixing hole 20C and the second fixing hole 20D.

The position of the center axis of the first fixing hole 20A and the position of the center axis of the first fixing hole 20B are aligned with each other along the arrow FH direction. The position of the center axis of the second fixing hole 20C and the position of the center axis of the second fixing hole 20D are aligned with each other along the arrow FH direction. In addition, the positions of the center axes of the second fixing hole 20C and the second fixing hole 20D are configured further toward a length direction central portion of the base plate 16A so as to be further toward the arrow WH direction inside than the positions of the center axes of the first fixing hole 20A and the first fixing hole 20B. The position of the center axis of the second fixing hole 20C is further to the arrow FH direction outside than the position of the center axis of the first fixing hole 20A. Moreover, the position of the center axis of the second fixing hole 20D is further toward the arrow FH direction outside than the position of the center axis of the first fixing hole 20B.

The position of the center axis of the first fixing hole 20A is aligned with the position of the center axis of the first fixing hole 18A along the arrow WH direction, and the position of the center axis of the first fixing hole 20B is aligned with the position of the center axis of the first fixing hole 18B along the arrow WH direction. The position of the center axis of the second fixing hole 20C is aligned with the position of the center axis of the second fixing hole 18C along the arrow WH direction, and the position of the center axis of the second fixing hole 20D is aligned with the position of the center axis of the second fixing hole 18D along the arrow WH direction.

The base plate 16A is thereby provided with the four fixing holes of the first fixing hole 18A, the first fixing hole 18B, the second fixing hole 18C, and the second fixing hole 18D, and the four fixing holes of the first fixing hole 20A, the first fixing hole 20B, the second fixing hole 20C, and the second fixing hole 20D, to give a total of eight fixing holes.

As illustrated in FIG. 1 and FIG. 2, indented portions 22 are formed to the lower face of the base plate 16A at the periphery of each of the eight fixing holes of the first fixing hole 18A to the second fixing hole 20D; the horizontal direction upper face (bottom face of the indented portions 22) of each of the indented portions 22 is configured with a flat plane shape. The indented portions 22 are formed in substantially triangular shapes in plan view, and gradually widen on progression toward the outer peripheral side of the base plate 16A, with the indented portions 22 open to the outside of the outer periphery of the base plate 16A. At base plate 16A center side portions, the vertical direction peripheral face of each of the indented portions 22 is configured in the same plane as the inner face of the respective fixing holes of the first fixing hole 18A to the second fixing hole 20D. The mortar 14 fills the whole of the indented portions 22, and the base plate 16A is fixed by the mortar 14.

A first anchor member is fixed to the foundation 12 at each of the first fixing portions of the base member 16, and a second anchor member is fixed to the foundation 12 at each of the second fixing portions. The first anchor members include first anchor bolts (anchor locks) 24 and second anchor bolts (anchor locks) 24. The second anchor members include first anchor bolts (anchor locks) 28 and second anchor bolts (anchor locks) 26.

The first anchor bolts 24 and the second anchor bolts 24 of the first anchor members are each equipped with a circular rod shaped anchor body 24A, with the anchor body 24A disposed with its axial direction along the up-down direction. Except for an upper end portion 24C, most of the anchor body 24A, including a lower end portion 24B, pierces through the mortar 14 and is buried in the foundation 12. The first anchor bolts 28 of the second anchor members are each equipped with a circular rod shaped anchor body 28A, with the anchor body 28A disposed with its axial direction along the up-down direction. Except for an upper end portion 28C, most of the anchor body 28A, including a lower end portion 28B, pierces through the mortar 14 and is buried in the foundation 12. The second anchor bolts 26 of the second anchor members are each equipped with a circular rod shaped anchor body 26A, with the anchor body 26A disposed with its axial direction along the up-down direction. Except for an upper end portion 26C, most of the anchor body 26A, including a lower end portion 26B, pierces through the mortar 14 and is buried in the foundation 12.

A male thread is provided to the lower end portion 24B of the anchor body 24A of each of the first anchor bolts 24 and the second anchor bolts 24 of the first anchor members. Two nuts, a nut 24D and a nut 24E, are provided screwed onto the male thread in the up-down direction. A circular ring flat plate shaped fixing plate 24F configuring an anchor portion is interposed between the nut 24D and the nut 24E, so as to project further to the outside than the shaft diameter of the anchor body 24A. The fixing plate 24F is fixed by tightening of the nut 24D and the nut 24E. The nut 24D, the nut 24E and the fixing plate 24F are buried in the foundation 12, and are configured to prevent the first anchor bolt 24 from being pulled out.

The upper end portions 24C of the anchor bodies 24A are respectively configured so as to pierce through and project out from the first fixing hole 18A, the first fixing hole 18B, the second fixing hole 18C, and the second fixing hole 18D of the base plate 16A. A male thread is provided to the upper end portion 24C, and a nut 24G for fixing the base plate 16A is screwed onto the male thread. A circular ring flat plate shaped washer 24H is interposed between the base plate 16A and the nut 24G.

In the first anchor bolts 28 of the second anchor members, two nuts, a nut 28D and a nut 28E, are provided screwed onto a male thread provided to the lower end portion 28B of the anchor body 28A. A circular ring flat plate shaped fixing plate 28F is interposed between the nut 28D and the nut 28E. The fixing plate 28F is fixed by tightening of the nut 28D and the nut 28E. The nut 28D, the nut 28E and the fixing plate 28F are buried in the foundation 12, and are configured to prevent the first anchor bolt 28 from being pulled out. The upper end portions 28C of the anchor bodies 28A are respectively configured so as to pierce through and project out from the first fixing hole 20A and the first fixing hole 20B serving as second fixing portions of the base plate 16A. A male thread is provided to the upper end portion 28C, and a nut 28G for fixing the base plate 16A is screwed onto the male thread. A circular ring flat plate shaped washer 28H is interposed between the base plate 16A and the nut 28G.

Similarly, in the second anchor bolts 26 of the second anchor members, two nuts, a nut 26D and a nut 26E, are screwed onto a male thread provided to the lower end portion 26B of the anchor body 26A. A circular ring flat plate shaped fixing plate 26F is interposed between the nut 26D and the nut 26E. The fixing plate 26F is fixed by tightening of the nut 26D and the nut 26E. The nut 26D, the nut 26E and the fixing plate 26F are buried in the foundation 12, and are configured to prevent the second anchor bolt 26 from being pulled out. The upper end portions 26C of the anchor bodies 26A are respectively configured so as to pierce through and project out from the second fixing hole 20C and the second fixing hole 20D of the base plate 16A. A male thread is provided to the upper end portion 26C, and a nut 26G for fixing the base plate 16A is screwed onto the male thread. A circular ring flat plate shaped washer 26H is interposed between the base plate 16A and the nut 26G.

In the present exemplary embodiment, the first anchor bolts 24 and the second anchor bolts 24 of the first anchor members and the second anchor bolts 26 of the second anchor members are formed with the same diameters as each other, and with the same axial direction lengths. The first anchor bolts 28 of the second anchor members are for example configured with a larger axial diameter than the first anchor bolts 24 of the first anchor members, and are formed with high tensile strength. More precisely, the first anchor bolts 24, the second anchor bolts 24, the first anchor bolts 28 and the second anchor bolts 26 are for example formed from a carbon steel material having a tensile strength such as 400 $N/mm^2$, or 490 $N/mm^2$ as defined by JIS specification G3138. An anchor bolt formed from stainless steel having a tensile strength of 520 $N/mm^2$ as defined by JIS specification G4321 may also be employed therefor. The diameter of the first anchor bolts 24, the second anchor bolts 24, and the second anchor bolts 26 is for example set at 30 mm ("M30" in screw terms), and the diameter of the first anchor bolts 28 is for example set at 36 mm ("M36" in screw terms).

At a center portion on the upper face of the base plate 16A, a steel column 30 is provided as a column member, with its length direction extending in the up-down direction. A lower end of the steel column 30 is joined, for example by arc welding, to the upper face of the base plate 16A.

The steel column 30 is, in the present exemplary embodiment, formed from H-section steel, and includes a web 30A and a pair of flanges 30B that are integrally provided at the two width direction ends of the web 30A. The web 30A of the steel column 30 is formed in an elongated rectangular flat plate shape with its width direction running along the arrow WH direction and its length direction running along the arrow UP direction. The pair of flanges 30B are each formed in an elongated rectangular flat plate shape with their width directions running along the arrow FH direction and with their length directions running along the arrow UP direction. The two ends of the web 30A are integrally joined to width direction central portions of the flanges 30B. The steel column 30 is, for example formed from a rolled structural steel for use in construction as defined by JIS specification G3136, a rolled steel for use in welded structures as defined by JIS specification G3106, or a rolled steel for use in general purpose structures as defined by JIS specification G3101.

Note that normally there are plural of the column structures 10 provided in a building. Although not illustrated in the drawings, foundation beams span across between lower end portions of the steel columns 30 of adjacent column structures 10, so as to arrange the main foundation beam layout.

Building Structure

Figure 3:
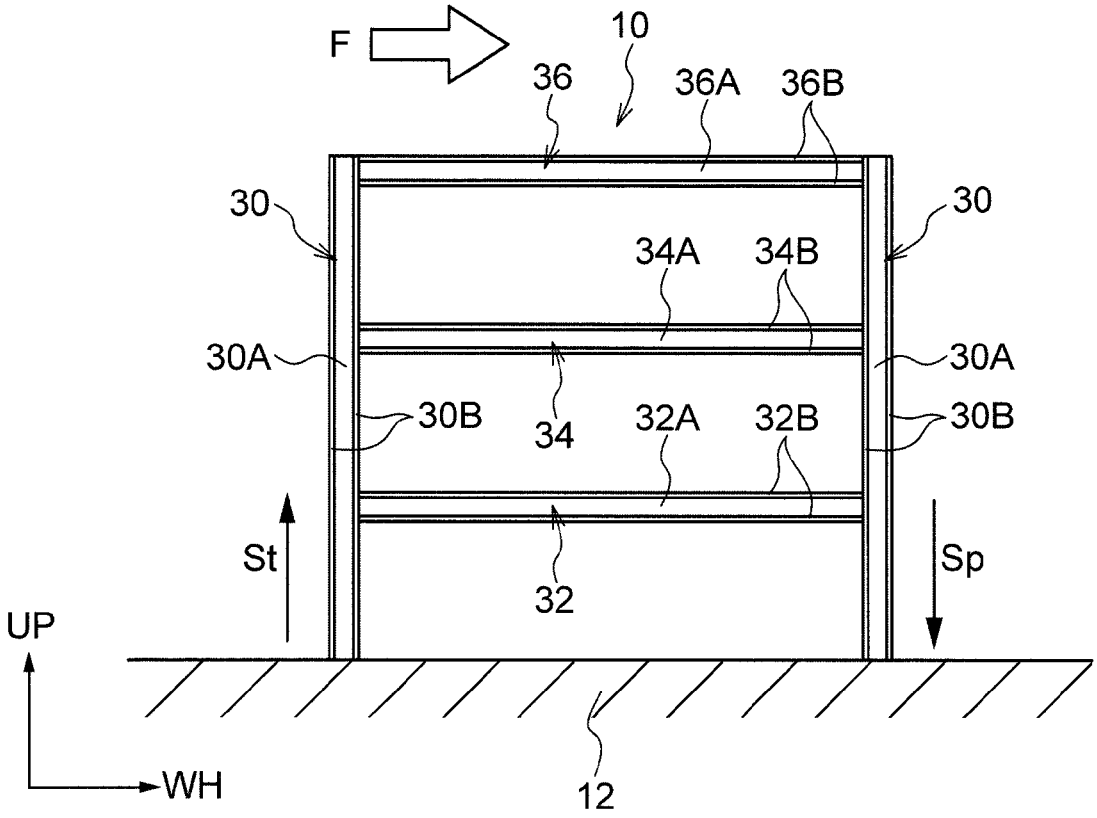
FIG. 3 is a schematic side view of a building applied with a column structure and a base member according to the first exemplary embodiment.
Figure 4:
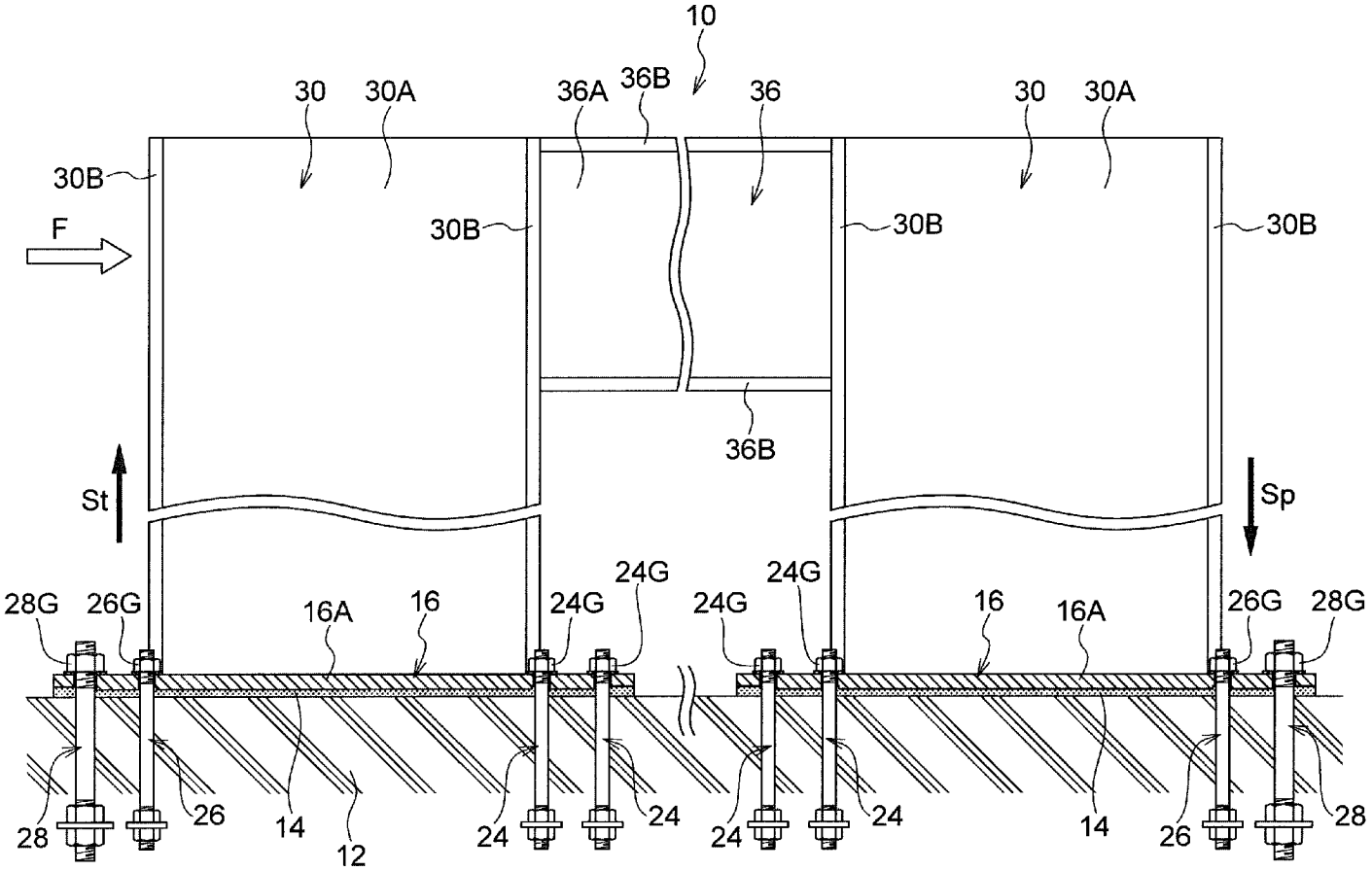
FIG. 4 is an enlarged side view of relevant portions of the building illustrated in FIG. 3.

FIG. 3 is a schematic side view illustrating a structure of a building constructed using the column structure 10 and the base member 16 according to the present exemplary embodiment. FIG. 4 is a side view illustrating a structure of relevant portions of the building.

In the column structure 10 illustrated on the left hand side in FIG. 3 and FIG. 4, the first fixing hole 18A, the first fixing hole 18B, the second fixing hole 18C and the second fixing hole 18D (see FIG. 1 and FIG. 2) serving as the first fixing portions of the base member 16 are disposed on the building inside (on the right hand side). The first anchor bolts 24 and the second anchor bolts 24 serving as the first anchor members are fixed to the base plate 16A on the building inside. The first fixing hole 20A, the first fixing hole 20B, the second fixing hole 20C and the second fixing hole 20D (see FIG. 1 and FIG. 2) serving as the second anchor members of the base member 16 are disposed on the building outside (left hand side). The first anchor bolts 28 and the second anchor bolts 26 serving as the second anchor members are fixed to the base plate 16A on the building outside.

The column structure 10 illustrated on the right hand side in FIG. 3 and FIG. 4 is configured so as to be rotated through 180 degrees with respect to the left hand side column structure 10 about a center axial line, not illustrated in the drawings, that runs in the arrow UP direction of the building. Namely, in the right hand side column structure 10, the first fixing hole 18A, the first fixing hole 18B the second fixing hole 18C, and the second fixing hole 18D serving as the first fixing portions of the base member 16 are disposed on the building inside (left hand side). The first anchor bolts 24 and the second anchor bolts 24 serving as the first anchor members are fixed to the base plate 16A on the building inside. The first fixing hole 20A, the first fixing hole 20B, the second fixing hole 20C and the second fixing hole 20D serving as the second fixing portions of the base member 16 are disposed on the building outside (right hand side). The first anchor bolts 28 and the second anchor bolts 26 serving as the second anchor members are fixed to the base plate 16A on the building outside.

Note that as illustrated in FIG. 3, a first beam member 32, a second beam member 34, and a third beam member 36 are provided between the left hand side column structure 10 and the right hand side column structure 10 so as to partition each story. One end portion on the left side of the first beam member 32 is joined to the steel column 30 of the left hand side column structure 10 using arc welding or bolt fastening, and the other end portion on the right side of the first beam member 32 is joined to the steel column 30 of the right hand side column structure 10 by similar joining means. In the present exemplary embodiment, an H-section steel beam integrally provided with flanges 32B at both width direction (arrow UP direction) ends of a web 32A is employed as the first beam member 32. Both end portions of the second beam member 34 are similarly joined to the respective steel columns 30 of the left and right side column structures 10, and both end portions of the third beam member 36 are joined to the respective steel columns 30 of the left and right side column structures 10. An H-section steel beam with a web 34A and flanges 34B is employed for the second beam member 34, and an H-section steel beam with a web 36A and flanges 36B is employed for the third beam member 36. Note that the first beam member 32, the second beam member 34, and the third beam member 36 may also be formed from beam members such as I-section steel beams or square section steel beams.

Operation and Advantageous Effects of the First Exemplary Embodiment

As illustrated in FIG. 1 and FIG. 2, in the column structure 10 and the base member 16 according to the present exemplary embodiment, the steel column 30 integrally provided with the flanges 30B at both width direction end portions of the web 30A is joined to the upper side of the base plate 16A. The lower end sides of the first anchor members and the second anchor members are fixed to the foundation 12, and the base plate 16A is fixed to the upper end sides of the first anchor members and the second anchor members.

The upper end sides of the first anchor bolts 24 and the second anchor bolts 24 serving as the first anchor members are fixed to the base plate 16A at one width direction end side of the web 30A. The upper end sides of the first anchor bolts 28 and the second anchor bolts 26 serving as the second anchor members are fixed to the base plate 16A at the other width direction end side of the web 30A. The tensile strength of the first anchor bolts 28 of the second anchor members is higher than the tensile strength of the first anchor bolts 24 of the first anchor members.

As illustrated in FIG. 1, FIG. 3 and FIG. 4, when a force F due to an earthquake or the like acting from the left hand side toward the right hand side in the arrow WH direction (horizontal direction) arises at the outer periphery of the building, at the left hand side column structure 10 of the building on which the force F acts, the greatest tensile axial force St arises at the flange 30B on the steel column 30 outside. At the right hand side column structure 10 of the building, the greatest compression axial force Sp arises at the flange 30B on the steel column 30 outside. In the event of an earthquake, the direction of the force F alternates back and forth, such that the tensile axial force St and the compression axial force Sp act alternately at the flange 30B of the left hand side column structure 10 as the compression axial force Sp and the tensile axial force St act alternately at the flange 30B of the right hand side column structure 10.

Figure 5:
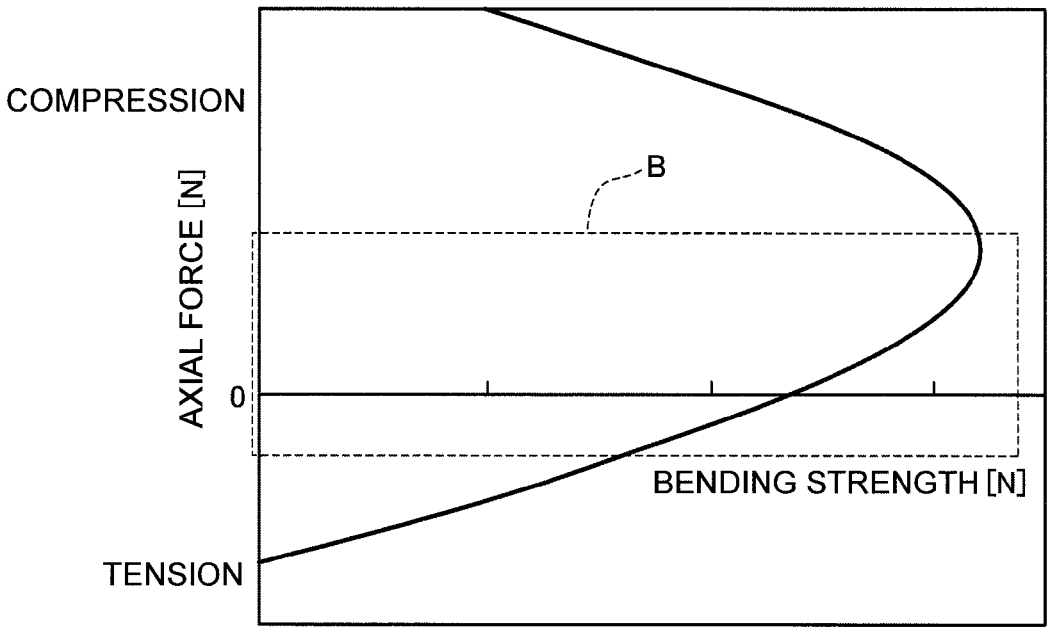
FIG. 5 is a drawing illustrating a relationship between axial force of a column member and column seat bending strength in a column structure and a base member according to the first exemplary embodiment.

FIG. 5 illustrates a relationship between the axial force (N) arising in the steel column 30 and column seat bending strength (N) in the column structure 10. As illustrated in FIG. 5, the column seat bending strength with respect to compression axial force arising in the steel column 30 is high, however the column seat bending strength with respect to tensile axial force in the steel column 30 is weak. There is accordingly a need to increase the column seat bending strength with respect to tensile axial force. Note that the region B surrounded by the broken line is the range of axial forces arising in a typical building, and there is a tendency toward weak column seat bending strength with respect to tensile axial force even within the region B.

In the column structure 10 and the base member 16 according to the present exemplary embodiment, the first fixing hole 20A and the first fixing hole 20B serving as the second fixing portions in the base plate 16A on the building outside are configured with enlarged diameters. In addition, the first anchor bolts 28 serving as second anchor members configured with greater tensile strength than the first anchor members are provided through the first fixing hole 20A and the first fixing hole 20B. Namely, second fixing portions of the base plate 16A are provided with the second anchor members that have high tensile strength, the second anchor members thereby effectively suppressing a large tensile axial force from acting in the steel column 30. The column seat bending strength of the column structure 10 can accordingly be raised by the simple configuration in which the tensile strength of the second anchor members, and in particular of the first anchor bolts 28, is raised.

As illustrated in FIG. 1 and FIG. 2, in the column structure 10 and the base member 16 according to the present exemplary embodiment the shaft diameter of the first anchor bolts 28 of the second anchor members is formed larger than the shaft diameter of the first anchor bolts 24 of the first anchor members. The tensile strength of the first anchor bolts 28 can accordingly be raised, and the column seat bending strength of the column structure 10 can be raised, by the simple configuration in which the shaft diameter of the first anchor bolts 28 is increased.

As illustrated in FIG. 1, in the column structure 10 and the base member 16 according to the present exemplary embodiment, the base plate 16A is fixed to the upper end portions 24C of the second anchor bolts 24 of the first anchor members provided on the width direction inside of the web 30A. Similarly, the base plate 16A is fixed to the upper end portions 26C of the second anchor bolts 26 of the second anchor members provided on the width direction inside of the web 30A. As illustrated in FIG. 1 and FIG. 2, the second anchor bolts 24 are brought closer to the flange 30B of the steel column 30, to give a small separation distance L between the flange 30B and the second anchor bolts 24. There is similarly a small separation distance between the flange 30B and the second anchor bolts 26. Explanation here focuses on the first anchor member side only. Increasing the total number of the first anchor bolts 24 and the second anchor bolts 24 provided to the base plate 16A (or increasing the total number of the holes of the first fixing hole 18A, the first fixing hole 18B, the second fixing hole 18C and the second fixing hole 18D) necessitates an increase in the thickness (up-down direction thickness dimension) t of the base plate 16A.

The total number of the first anchor bolts 24 and the second anchor bolts 24 provided at the periphery of one of the flanges 30B of the base plate 16A is denoted n. In the present exemplary embodiment, n equals 4. The yield tensile strength in the axial direction of the $i^{th}$ first anchor bolt 24 or the second anchor bolt 24 in the arrow FH direction is denoted Ti. The arrow WH direction separation distance between the center axis of the $i^{th}$ first anchor bolt 24 or second anchor bolt 24 and the flange 30B is denoted Li. Moreover, the arrow FH direction dimension of the base plate 16A (width dimension) is denoted B, the thickness of the base plate 16A is denoted t, and the yield point of the base plate 16A material is denoted σ. In this case, the base plate 16A conforms to the following relationship expression (1).

$$\sum_{i=1}^{n} TiLi \leq B(t^2/6)\sigma$$

In the above relationship expression, reducing the separation distance Li on the left side reduces the thickness t on the right side. Namely, in the present exemplary embodiment, by actively reducing the separation distance Li, the thickness of the base plate 16A can be made thinner. The material costs of the base plate 16A can be reduced, thereby enabling a saving in material costs and manufacturing costs of the column structure 10.

Moreover, in the column structure 10 and the base member 16 according to the present exemplary embodiment, the first anchor bolts 24 of the first anchor members are disposed on the building inside, and the first anchor bolts 28 of the second anchor members are disposed on the building outside. For example, when a tensile axial force arises in the steel column 30, the larger tensile axial force arises on the building outside of the steel column 30. The location (on the second fixing portion side) where tensile axial force acts in the base plate 16A is fixed by the first anchor bolts 28 of the second anchor members that have high tensile strength. The large tensile axial force is thereby suppressed by the high tensile strength first anchor bolts 28, thereby enabling the column seat bending strength of the column structure 10 to be raised.

Moreover, in the column structure 10 and the base member 16 according to the present exemplary embodiment, the indented portions 22 are provided at the base plate 16A lower side. The mortar 14 fills the indented portions 22, and the base plate 16A is anchored to the foundation 12 through the mortar 14. Thus when horizontal load arises such as during an earthquake, displacement of the base member 16 with respect to the foundation 12 can be suppressed. This thereby enables the shear capacity of the column structure 10 and the base member 16 to be raised since shear stress is suppressed from being transmitted from the steel column 30 to the foundation 12 through the base plate 16A and the first anchor members and second anchor members.

Note that in the column structure 10 and the base member 16 of the present exemplary embodiment, the tensile strength is raised on the other end side with respect to the one end side in the arrow WH direction (web 30A width direction) of the base plate 16A illustrated in FIG. 2. In the present exemplary embodiment, the tensile strength may be raised on the other end side with respect to one end side in the arrow FH direction (flanges 30B width direction) of the base plate 16A. In such cases, the force F acting on the building acts in the arrow FH direction.

Moreover, in the present exemplary embodiment the tensile strength is raised by the first fixing hole 20A and the first fixing hole 20B of the second fixing portions and the first anchor bolts 28 of the second anchor members. In addition, the diameter of the second fixing hole 20C and the second fixing hole 20D of the second fixing portions may be increased, and the shaft diameter of the second anchor bolts 26 may be increased, thereby increasing the overall tensile strength of the second fixing portions and also of the second anchor members.

Second Exemplary Embodiment

Figure 6:
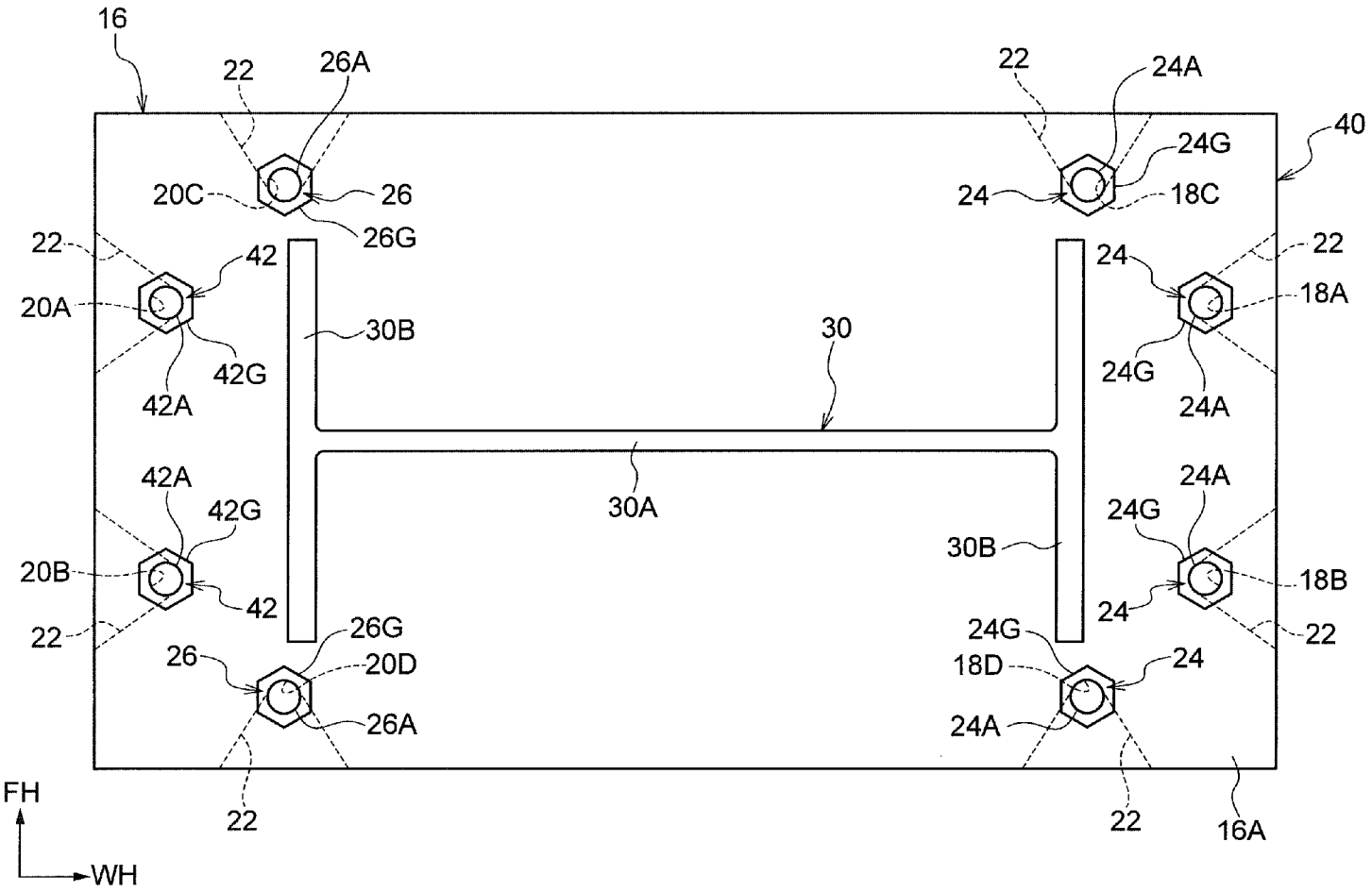
FIG. 6 is a plan view corresponding to FIG. 2 of a column structure and a base member according to a second exemplary embodiment of the present invention.

Explanation follows regarding a column structure and base member according to a second exemplary embodiment of the present invention, with reference to FIG. 6. Note that in the present exemplary embodiment, as well as in subsequently described exemplary embodiments, configuration that is the same as configuration of the column structure 10 and the base member 16 according to the first exemplary embodiment is appended with the same reference numerals, and repetition of explanation of such configurations is omitted.

Column Structure and Base Member Configuration

As illustrated in FIG. 6, in a column structure 40 and a base member 16 according to the present exemplary embodiment, configuration of a first fixing hole 20A and a first fixing hole 20B of second fixing portions, and configuration of first anchor bolts 42 of second anchor members, respectively shown on the left hand side in the drawing, differ from the configuration of the first exemplary embodiment. Other configurations of the column structure 40 and the base member 16 according to the present exemplary embodiment are similar to configuration of the column structure 10 and the base member 16 according to the first exemplary embodiment.

More specifically, the first fixing hole 20A and the first fixing hole 20B of the column structure 40 and the base member 16 are formed as circular shaped through holes having the same diameter as the first fixing hole 18A and the first fixing hole 18B of the first fixing portions. Note that the first fixing hole 20A and the first fixing hole 20B are also formed with the same diameter as the second fixing hole 20C and the second fixing hole 20D of the second fixing portions and the second fixing hole 18C and the second fixing hole 18D of the first fixing portions.

The first anchor bolts 42 serving as second anchor members are configured with the same diameter as the first anchor bolts 24, and are formed from a material with a higher tensile strength than the first anchor bolts 24. Upper end portions 42C of the first anchor bolts 42 are provided with a male thread similarly to the upper end portions 24A of the anchor bolts 24. Nuts 42G are screwed onto the male thread of the first anchor bolts 42 that pierce the first fixing hole 20A and the first fixing hole 20B with washers, omitted from illustration, interposed. Similarly to the first anchor bolts 24, lower end sides of the first anchor bolts 42, omitted from illustration, are provided with double nuts and fixing plates that are fastened by the double nuts. The upper end sides of the first anchor bolts 42 are thereby fixed to the base plate 16A.

For example, when the anchor bolts 24 are formed from a carbon steel material having a tensile strength of 400 $N/mm^2$ as defined by JIS specification G3138, the first anchor bolts 42 may be formed from a carbon steel material having a tensile strength of 490 $N/mm^2$. The first anchor bolts 42 may also be formed from a stainless steel material with a higher tensile strength than the first anchor bolts 24.

Note that in the present exemplary embodiment, the second anchor bolts 26 serving as the second anchor members may be formed from a material with a high tensile strength similarly to the first anchor bolts 42. The length of the second anchor bolts 42 and the length of the first anchor bolts 24 may differ from each other under the condition that the tensile strength of the first anchor bolts 42 is higher than that of the anchor bolts 24.

Operation and Advantageous Effects of the Second Exemplary Embodiment

As illustrated in FIG. 6, in the column structure 40 and the base member 16 according to the present exemplary embodiment, the first anchor bolts 42 of the second anchor members are formed from a material with a higher tensile strength than the anchor bolts 24 of the first anchor members. The tensile strength of the second anchor members can accordingly be raised, and column seat bending strength of the column structure 40 can be raised by the simple configuration in which the first anchor bolts 42 are formed from a material having high tensile strength.

In addition to the above operation and advantageous effects, the column structure 40 and the base member 16 according to the present exemplary embodiment can obtain similar operation and advantageous effects to those obtained by the column structure 10 and the base member 16 according to the first exemplary embodiment.

Third Exemplary Embodiment

Figure 7:
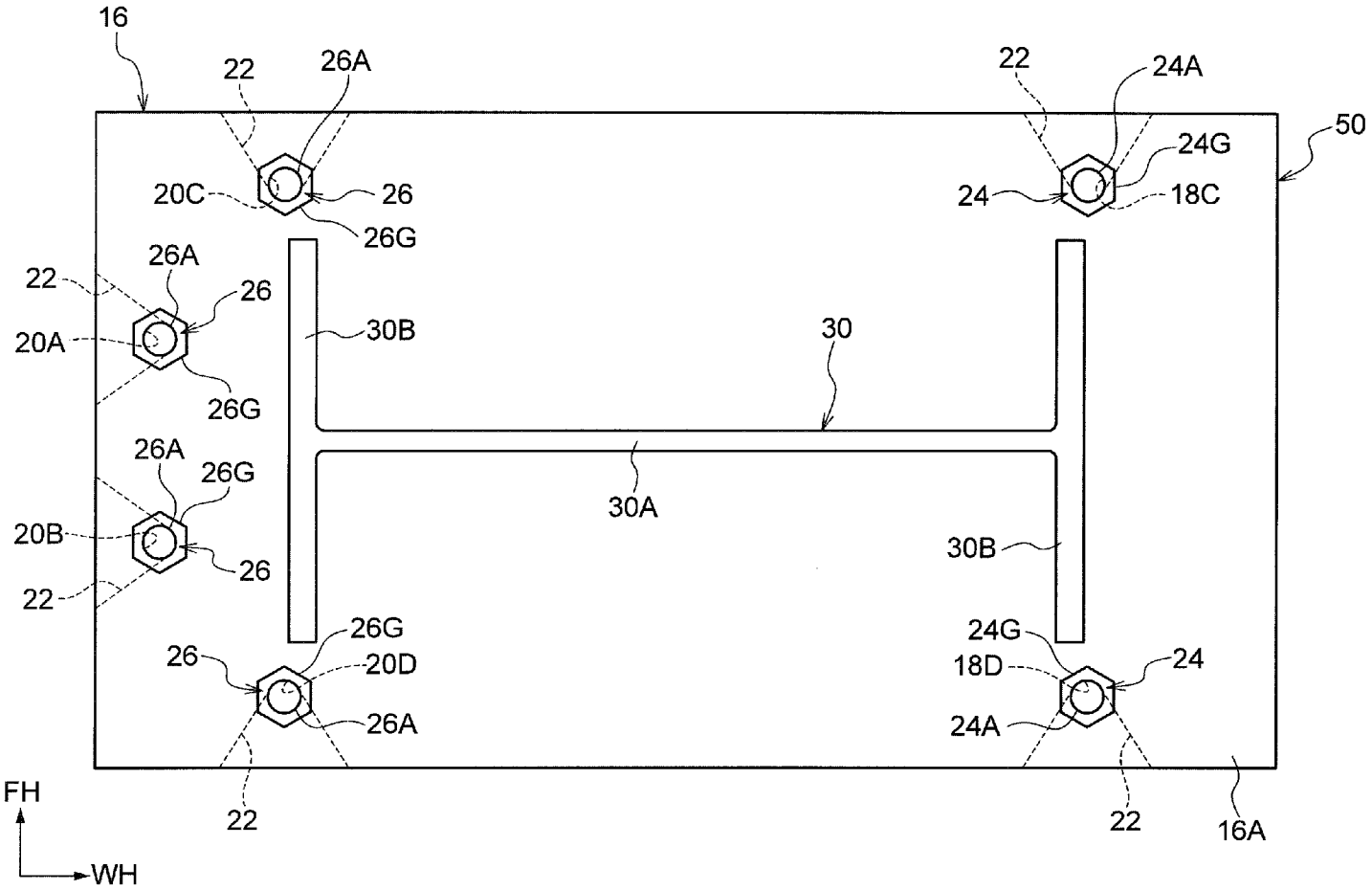
FIG. 7 is a plan view corresponding to FIG. 2 of a column structure and a base member according to a third exemplary embodiment of the present invention.

Explanation follows regarding a column structure and base member according to a third exemplary embodiment of the present invention, with reference to FIG. 7.

Column Structure and Base Member Configuration

As illustrated in FIG. 7, in a column structure 50 and a base member 16 according to the present exemplary embodiment, configuration of first fixing portions and first anchor members illustrated on the right hand side in the drawing, and configuration of second fixing portions and second anchor members illustrated on the left hand side in the drawing differ from the configuration of the first exemplary embodiment. Other configurations of the column structure 50 and the base member 16 according to the present exemplary embodiment are similar to configuration of the column structure 10 and the base member 16 according to the first exemplary embodiment.

More specifically, the first fixing portions of the column structure 50 and the base member 16 are configured with the first fixing hole 18A and the first fixing hole 18B (see FIG. 1 and FIG. 2) omitted, with two fixing holes, the second fixing hole 18C and the second fixing hole 18D. The second anchor bolts 24 serving as the first anchor members are provided to the second fixing hole 18C and the second fixing hole 18D respectively.

The second fixing portions are configured by two first fixing holes, the first fixing hole 20A and the first fixing hole 20B, and two second fixing holes, the second fixing hole 20C and the second fixing hole 20D. The first fixing hole 20A and the first fixing hole 20B are formed as circular shaped through holes having the same diameter as the second fixing hole 20C and the second fixing hole 20D, similarly to the first fixing hole 20A and the first fixing hole 20B (see FIG. 6) of the second exemplary embodiment described above. The first fixing hole 20A and the first fixing hole 20B are moreover formed with the same diameter as the second fixing hole 18C and the second fixing hole 18D of the first fixing portions. First anchor bolts 26 and second anchor bolts 26 serving as second anchor members are provided to the total of four fixing holes, namely the first fixing hole 20A, the first fixing hole 20B, the second fixing hole 20C, and the second fixing hole 20D. The first anchor bolts 26 are formed with the same diameter and the equivalent tensile strength to the second anchor bolts 26. Moreover, the first anchor bolts 26 are formed with the same diameter and the equivalent tensile strength to the first anchor bolts 24 of the first anchor members.

Namely, in the column structure 50 and the base member 16 according to the present exemplary embodiment, there are a greater number of the first anchor bolts 26 and the second anchor bolts 26 of the second anchor members provided than that of the first anchor members.

Operation and Advantageous Effects of the Third Exemplary Embodiment

As illustrated in FIG. 7, in the column structure 50 and the base member 16 according to the present exemplary embodiment, there are a greater number of the second anchor members provided than that of the first anchor members. The tensile strength of the second anchor members can be raised, and the column seat bending strength of the column structure 50 can be raised, by the simple configuration in which the number (quantity) of the second anchor members is varied.

In addition to the above operation and advantageous effects, the column structure 50 and the base member 16 according to the present exemplary embodiment can obtain similar operation and advantageous effects to those obtained by the column structure 10 and the base member 16 according to the first exemplary embodiment.

Fourth Exemplary Embodiment

Figure 8:
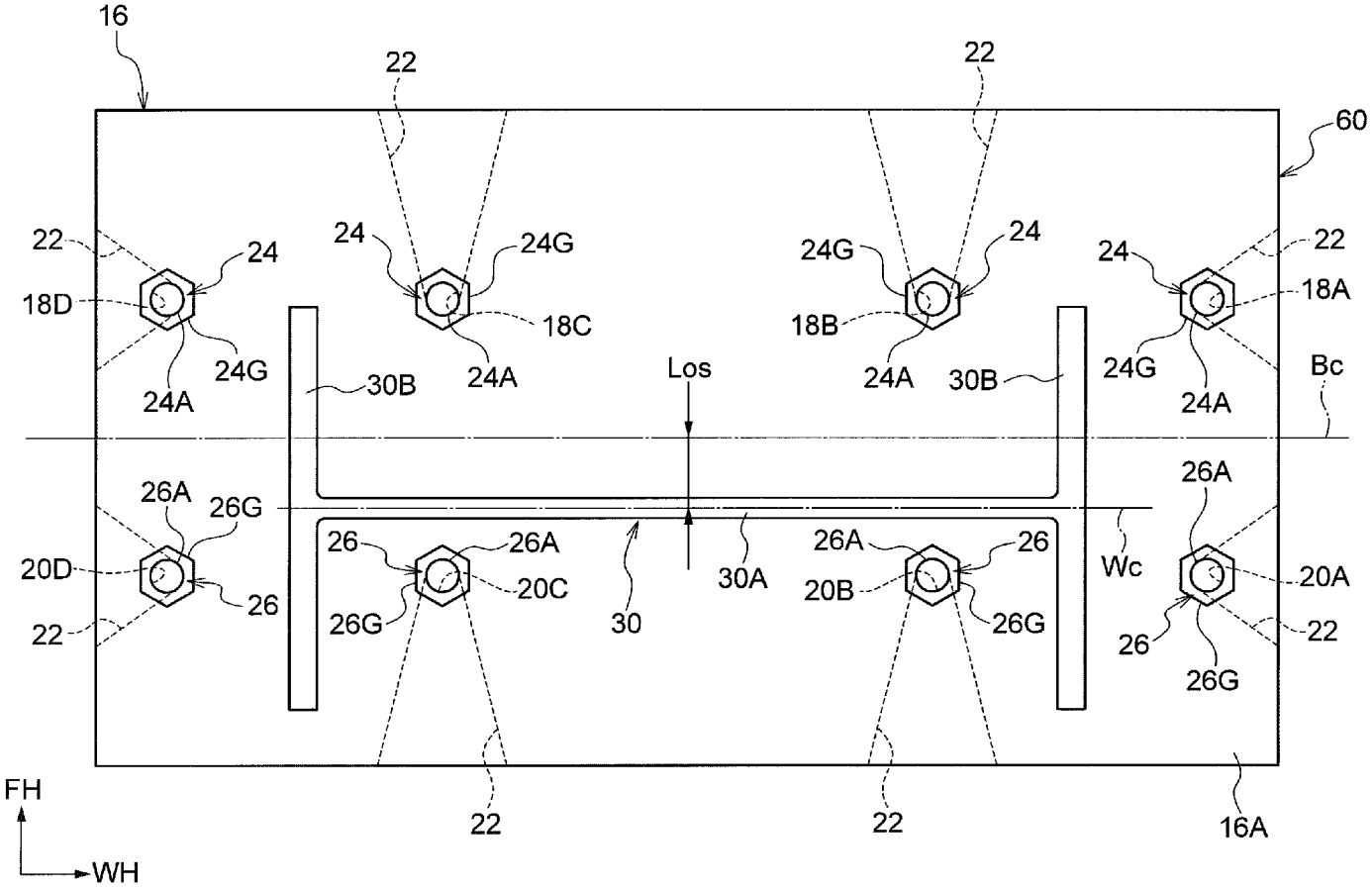
FIG. 8 is a plan view corresponding to FIG. 2 of a column structure and a base member according to a fourth exemplary embodiment of the present invention.

Explanation follows regarding a column structure and base member according to a fourth exemplary embodiment of the present invention, with reference to FIG. 8.

Column Structure and Base Member Configuration

As illustrated in FIG. 8, in a column structure 60 and a base member 16 according to the present exemplary embodiment, the steel column 30 is joined to the base plate 16A with a flange 30B width direction (arrow FH direction) center position Wc of the steel column 30 offset with respect to a flange 30B width direction center position Bc of the base plate 16A by a distance Los. Note that the center position Bc is a center position on the upper face of the base plate 16A, and the center position Wc is a center position on a lower face of the steel column 30. More specifically, in the present exemplary embodiment one end side of the base plate 16A on the arrow FH direction upper side is disposed at the outside of a building, omitted from illustration, and the other end side of the base plate 16A on the arrow FH direction lower side is disposed at the building inside. Namely, the steel column 30 is offset toward the side where the greatest tensile axial force arises.

In the present exemplary embodiment, two fixing holes of the first fixing hole 18A and the first fixing hole 18B serving as first fixing portions, and two fixing holes of the second fixing hole 18C and the second fixing hole 18D are provided on one end side of the base plate 16A. The center axis positions of the first fixing hole 18A, the first fixing hole 18B, the second fixing hole 18C and the second fixing hole 18D are aligned with each other along the arrow WH direction, and the first fixing hole 18A to the second fixing hole 18D are formed with the same diameter as each other. The first fixing hole 18A is disposed on the opposite side of the flange 30B to the web 30A. The first fixing hole 18B is disposed further to the web 30A width direction inside than the first fixing hole 18A, and is disposed on the web 30A side of the flange 30B. The second fixing hole 18D is disposed on the opposite side of the flange 30B to the web 30A. The second fixing hole 18C is disposed further toward the web 30A width direction inside than the second fixing hole 18D, and is disposed on the web 30A side of the flange 30B.

First anchor bolts 24 serving as first anchor members are provided to the first fixing hole 18A and the first fixing hole 18B, and second anchor bolts 24 serving as first anchor members are provided to the second fixing hole 18C and the second fixing hole 18D. The first anchor bolts 24 and the second anchor bolts 24 all formed with the same diameter, and are all formed with equivalent tensile strength.

Two first fixing holes, a first fixing hole 20A and a first fixing hole 20B, and two second fixing holes, a second fixing hole 20C and a second fixing hole 20D that serve as second fixing portions are provided on the other end side of the base plate 16A. The center axis positions of the first fixing hole 20A, the first fixing hole 20B, the second fixing hole 20C and the second fixing hole 20D are aligned with each other along the arrow WH direction, and the first fixing hole 20A to the second fixing hole 20D are formed with the same diameter as each other. The first fixing hole 20A to the second fixing hole 20D of the second fixing portions are moreover configured with the same diameter as the first fixing hole 18A to the second fixing hole 18D of the first fixing portions. The first fixing hole 20A is disposed on the opposite side of the flange 30B to the web 30A, and the center axis position of the first fixing hole 20A is aligned with the center axis position of the first fixing hole 18A in the arrow FH direction. The first fixing hole 20B is disposed further to the web 30A width direction inside than the first fixing hole 20A, and is disposed on the web 30A side of the flange 30B. The center axis position of the first fixing hole 20B is aligned with the center axis position of the first fixing hole 18B in the arrow FH direction. The second fixing hole 20D is disposed on the opposite side of the flange 30B to the web 30A, and the center axis position of the second fixing hole 20D is aligned with the center axis position of the second fixing hole 18D in the arrow FH direction. The second fixing hole 20C is disposed further toward the web 30A width direction inside than the second fixing hole 20D, and is disposed on the web 30A side of the flange 30B.

First anchor bolts 26 serving as second anchor members are provided to the first fixing hole 20A and the first fixing hole 20B, and second anchor bolts 26 serving as second anchor members are provided to the second fixing hole 20C and the second fixing hole 20D. The first anchor bolts 26 and the second anchor bolts 26 are all formed with the same diameter and the equivalent tensile strength to each other. The first anchor bolts 26 are moreover formed with the same diameter and the equivalent tensile strength to the first anchor bolts 24. The first anchor bolts 24, the second anchor bolts 24, the first anchor bolts 26 and the second anchor bolts 26 are moreover all provided an equal distance from the center position Bc of the base plate 16A.

Operation and Advantageous Effects of the Fourth Exemplary Embodiment

As illustrated in FIG. 8, in the column structure 60 and the base member 16 according to the present exemplary embodiment, the steel column 30 with the flanges 30B integrally provided to both width direction sides of the web 30A is joined to the upper side of the base plate 16A. The lower end sides of the first anchor members and the second anchor members are fixed to the foundation 12, and the base plate 16A is fixed to the upper end sides of the first anchor members and the second anchor members.

The first anchor bolts 24 and the second anchor bolts 24 of the first anchor members, and the first anchor bolts 26 and the second anchor bolts 26 of the second anchor members are formed with the equivalent tensile strength to each other. The upper end sides of the first anchor bolts 24 and the second anchor bolts 24 are fixed to the arrow FH direction one end side of the base plate 16A, and the upper end sides of the first anchor bolts 26 and the second anchor bolts 26 are fixed to the arrow FH direction other end side of the base plate 16A. The center position Wc of the steel column 30 is offset with respect to the center position Bc of the base plate 16A in the flanges 30B width direction, such that the steel column 30 reinforces the location (the other end side of the base plate 16A) of the base plate 16A where the steel column 30 is offset. For example, when force (force F illustrated in FIG. 1, FIG. 3 and FIG. 4) in the horizontal direction is imparted to the steel column 30 from the opposite side to the offset direction of the steel column 30, a large tensile axial force in the arrow UP direction arises in the steel column 30 at the location of the base plate 16A where the steel column 30 is offset. This large tensile axial force is effectively suppressed by the location of the base plate 16A reinforced by the offset steel column 30. Accordingly, the column seat bending strength of the column structure 60 can be raised by the simple configuration in which the steel column 30 is joined to the base plate 16A at an offset even when the first anchor members and the second anchor members have the equivalent tensile strength to each other (even without modification).

In addition to the above operation and advantageous effects, the column structure 60 and the base member 16 according to the present exemplary embodiment can obtain similar operation and advantageous effects to the operation and advantageous effects obtained by the column structure 10 and the base member 16 according to the first exemplary embodiment.

Note that in the column structure 60 and the base member 16 according to the present exemplary embodiment, configuration may be made such that the center position Bc of the base plate 16A and the center position Wc of the column member are aligned with each other, with both positions being offset in the arrow WH direction. In such a case, the steel column 30 is offset toward the building outside with respect to the base plate 16A. The first fixing hole 18A, the first fixing hole 18B, the first fixing hole 20A, and the first fixing hole 20B are disposed on the building inside, and are provided with the first anchor bolts 24 and the first anchor bolts 26. Moreover, the second fixing hole 18C, the second fixing hole 18D, the second fixing hole 20C, and the second fixing hole 20D are disposed on the building outside, and are provided with the second anchor bolts 24 and the second anchor bolts 26.

Fifth Exemplary Embodiment

Figure 9:
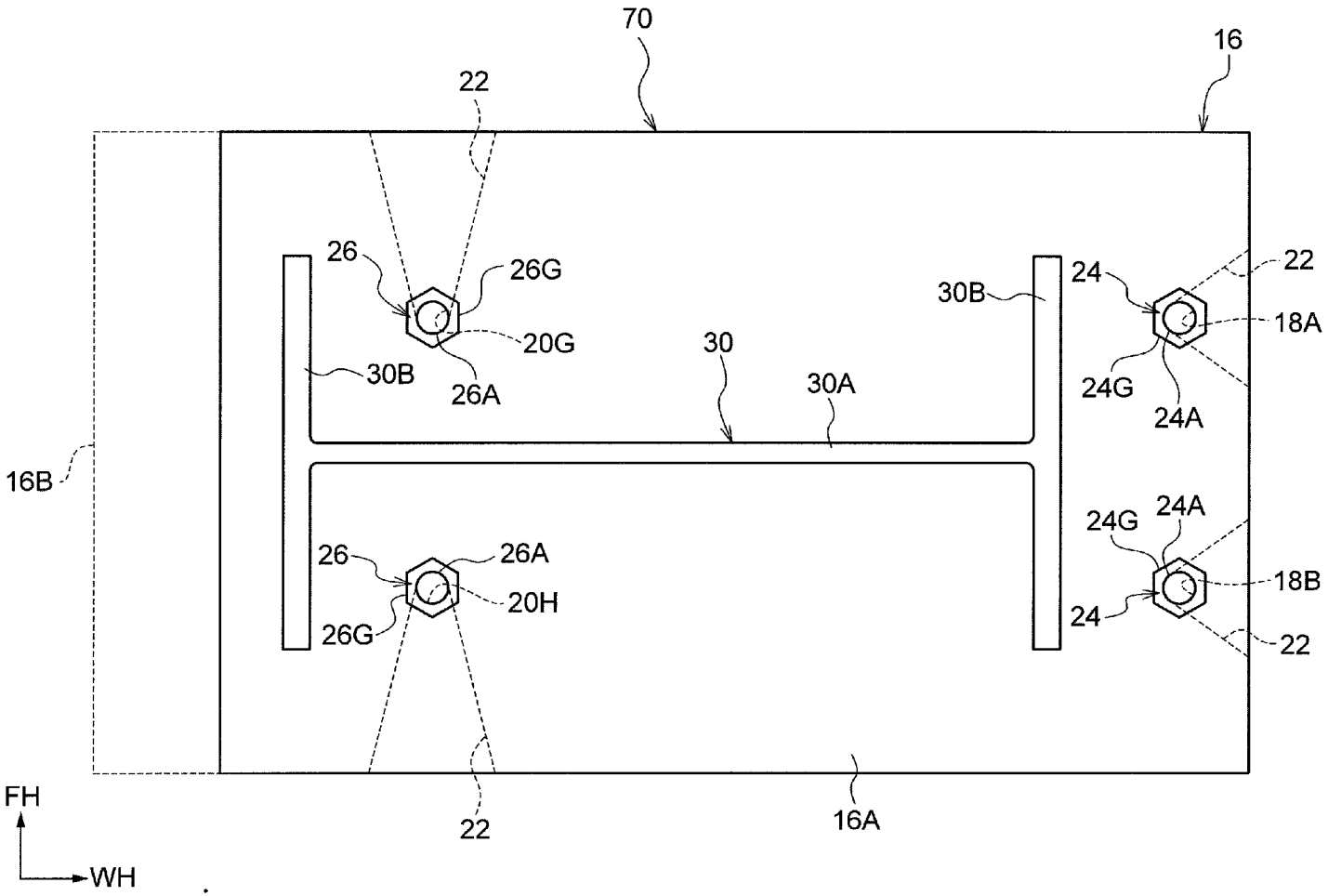
FIG. 9 is a plan view corresponding to FIG. 2 of a column structure and a base member according to a fifth exemplary embodiment of the present invention.

Explanation follows regarding a column structure and base member according to a fifth exemplary embodiment of the present invention, with reference to FIG. 9. The present exemplary embodiment is a modified example of the column structure 60 and the base member 16 according to the fourth exemplary embodiment.

Column Structure and Base Member Configuration

As illustrated in FIG. 9, in a column structure 70 and a base member 16 according to the present exemplary embodiment, the first fixing portions are configured by two first fixing holes, the first fixing hole 18A and the first fixing hole 18B, disposed on the opposite side of the flange 30B to the web 30A. The first fixing hole 18A and the first fixing hole 18B are provided with the first anchor bolts 24 serving as first anchor members.

The second fixing portions are configured by two second fixing holes, a second fixing hole 20G and a second fixing hole 20H, disposed on the web 30A side of the flange 30B. The second fixing hole 20G and the second fixing hole 20H are provided with the second anchor bolts 26 serving as the second anchor members. The second anchor bolts 26 are formed with the same diameter and the equivalent tensile strength to the first anchor bolts 24.

In the base plate 16A according to the present exemplary embodiment, the second fixing hole 20G and the second fixing hole 20H are disposed on the web 30A side of the flange 30B, and a region 16B on the opposite side of the flange 30B to the web 30A is omitted. As a result, the steel column 30 is offset with respect to the base plate 16A toward the left hand side in the web 30A width direction (in the arrow WH direction). The side to which the steel column 30 is offset is configured at the building outside.

Operation and Advantageous Effects of the Fifth Exemplary Embodiment

As illustrated in FIG. 9, in the column structure 70 and the base member 16 according to the present exemplary embodiment, the upper end sides of the second anchor bolts 26 serving as the second anchor members are fixed to the base plate 16A on the web 30A side of the flange 30B. The region 16B of the base plate 16A that is on the opposite side of the flange 30B to the web 30A can be omitted as a result.

As a result of omitting the region 16B of the base plate 16A, the arrow WH direction center position of the steel column 30 moves toward the other end side of the base plate 16A with respect to the arrow WH center position of the base plate 16A. The center position of the steel column 30 can thereby be simply configured so as to be offset with respect to the center position of the base plate 16A.

Moreover, in the column structure 70 and the base member 16 according to the present exemplary embodiment, the region 16B portion of the base plate 16A is omitted (a building outside portion of the base plate 16A is reduced), thereby achieving a reduction in weight of the base plate 16A. Moreover, since the quantity of material required for manufacture of the base plate 16A can be reduced, a reduction in manufacturing costs of the column structure 70 and the base member 16 is enabled.

Moreover, in the column structure 70 and the base member 16 according to the present exemplary embodiment, the region 16B of the base plate 16A on the opposite side of the flange 30B to the web 30A is omitted, thereby enabling the steel column 30 to be brought closer to an adjacent boundary. Efficient utilization of the building site is thereby enabled.

Sixth Exemplary Embodiment

Figure 10:
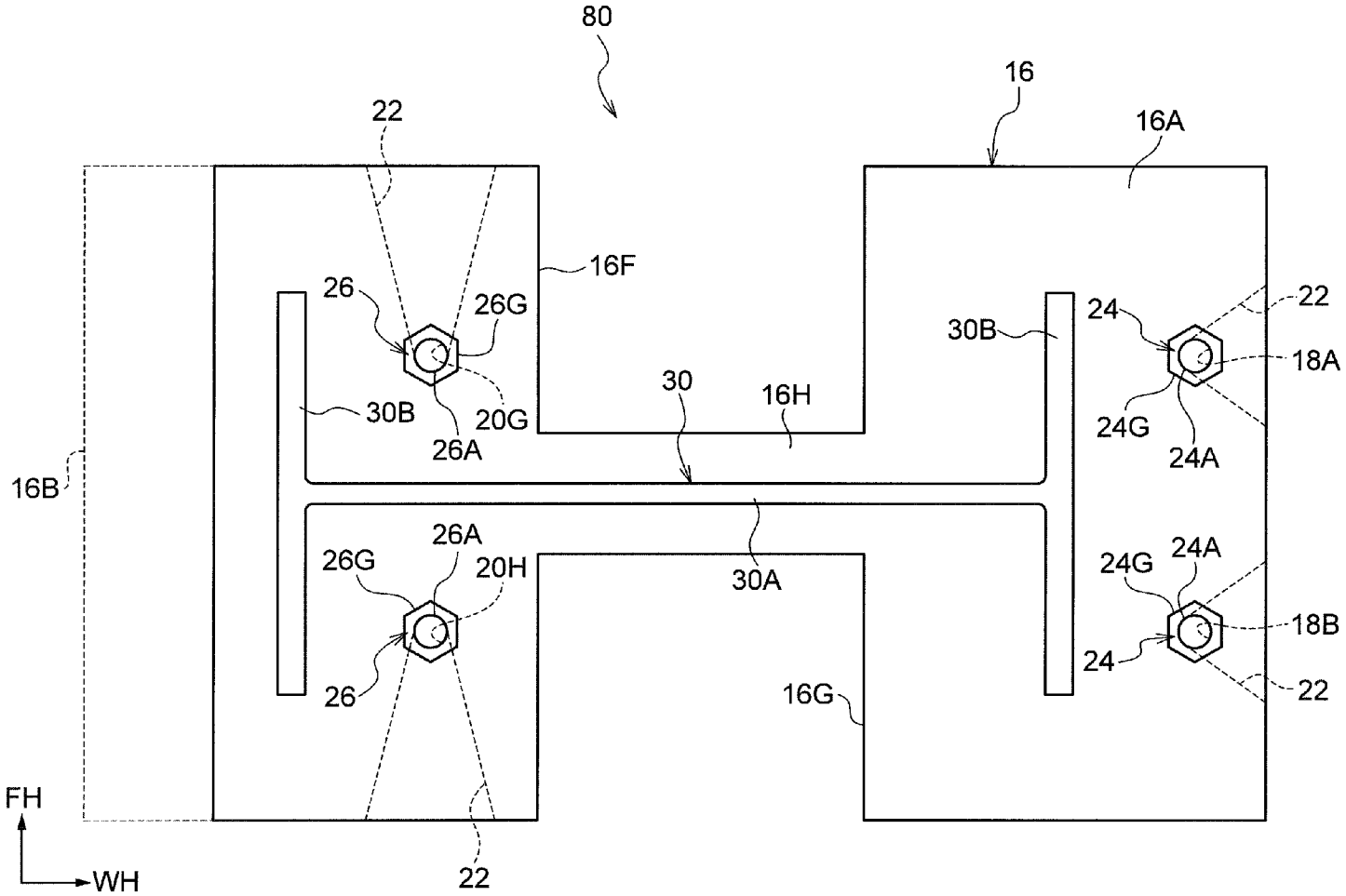
FIG. 10 is a plan view corresponding to FIG. 2 of a column structure and a base member according to a sixth exemplary embodiment of the present invention.

Explanation follows regarding a column structure and base member according to a sixth exemplary embodiment of the present invention, with reference to FIG. 10. The present exemplary embodiment is a modified example of the column structure 70 and the base member 16 according to the fifth exemplary embodiment.

Column Structure and Base Member Configuration

As illustrated in FIG. 10, in a column structure 80 according to the present exemplary embodiment, a cutaway portion 16F and a cutaway portion 16G are provided to the base plate 16A of the base member 16.

More specifically, the cutaway portion 16F is formed by cutting away a portion of the base plate 16A along the web 30A on one arrow FH direction end side of the base plate 16A between the pair of flanges 30B. The cutaway portion 16F is configured in a U shape (rectangular shape) open toward the one end side of the base plate 16A in plan view.

The cutaway portion 16G is formed by cutting away a portion of the base plate 16A along the web 30A on the arrow FH direction other end side of the base plate 16A between the pair of flanges 30B. In plan view, the cutaway portion 16G is configured in a U shape (rectangular shape) open toward the other end side of the base plate 16A symmetrically to the cutaway portion 16F.

A location of the base plate 16A is provided between the cutaway portion 16F and the cutaway portion 16G, with the web 30A joined to this location. In plan view, the overall base plate 16A has an H shape in the present exemplary embodiment.

Operation and Advantageous Effects of the Present Exemplary Embodiment

As illustrated in FIG. 10, in the column structure 80 and the base member 16 according to the present exemplary embodiment, the base plate 16A is provided with the cutaway portion 16F and the cutaway portion 16G. Locations equivalent to the cutaway portion 16F and the cutaway portion 16G can accordingly be omitted from the base plate 16A, enabling a reduction in weight of the base plate 16A.

In addition to the above operation and advantageous effects, the column structure 80 and the base member 16 according to the present exemplary embodiment can obtain similar operation and advantageous effects to those obtained by the column structure 70 and the base member 16 according to the fifth exemplary embodiment.

Note that the present exemplary embodiment may be applied to any out of the column structure 10 and the base member 16 according to the first exemplary embodiment to the column structure 60 and the base member 16 according to the fourth exemplary embodiment. The plan view shapes of the cutaway portion 16F and the cutaway portion 16G are not limited to U shapes, and may for example be configured with trapezoidal shapes or circular arc shapes. Moreover, slits may be formed in place of the cutaway portions.

Seventh Exemplary Embodiment

Figure 11:
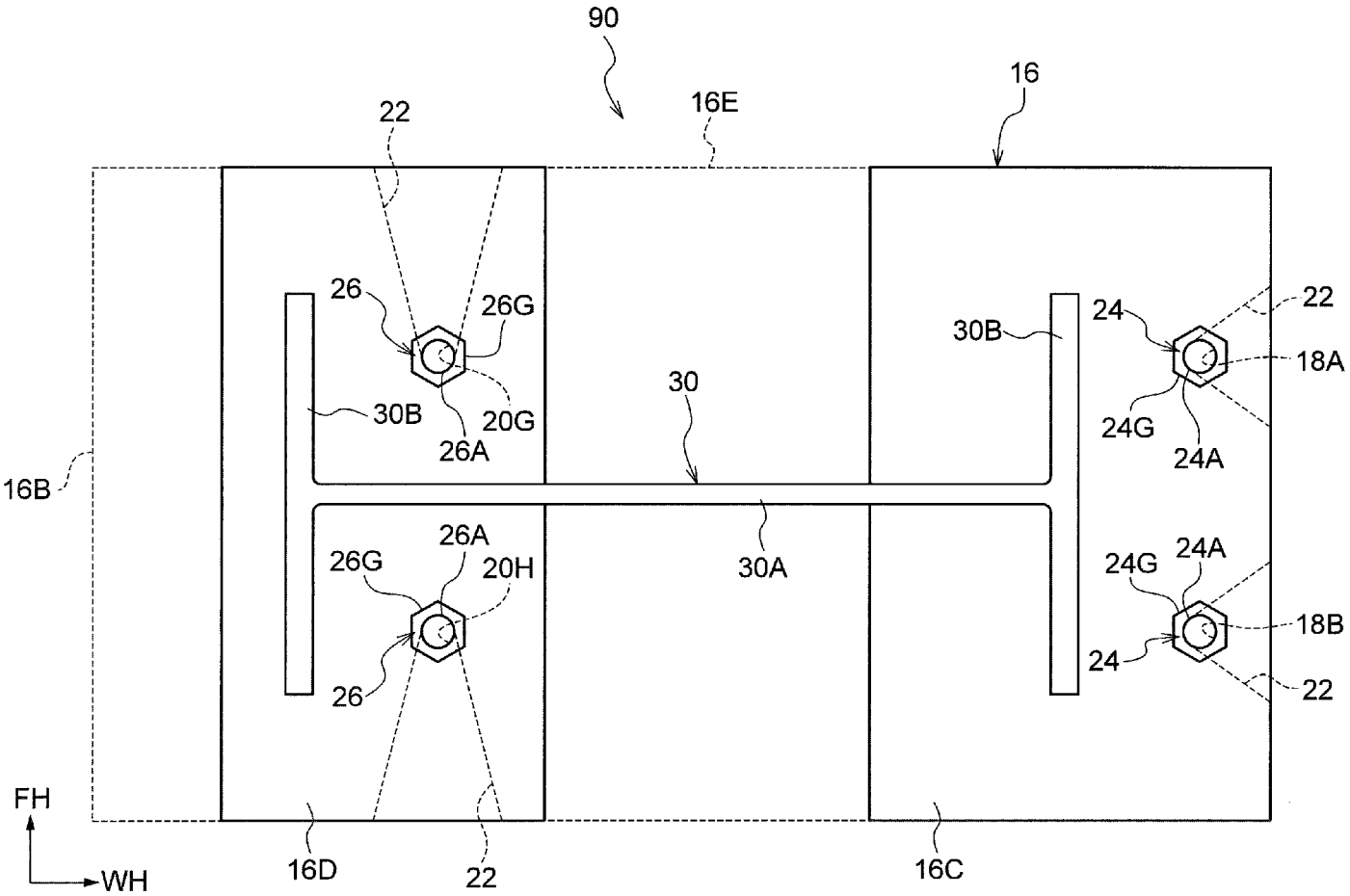
FIG. 11 is a plan view corresponding to FIG. 2 of a column structure and a base member according to a seventh exemplary embodiment of the present invention.

Explanation follows regarding a column structure and base member according to a seventh exemplary embodiment of the present invention, with reference to FIG. 11. The present exemplary embodiment is a modified example of the column structure 70 and the base member 16 according to the fifth exemplary embodiment.

Column Structure and Base Member Configuration

As illustrated in FIG. 11, in a column structure 90 according to the present exemplary embodiment, the base member 16 is configured from a first base member and a second base member. The first base member is provided with a first base plate 16C serving as a base body, and the second base member is provided with a second base plate 16D serving as a base body.

More specifically, the first base plate 16C is configured in a rectangular flat plate shape with its length direction along the arrow FH direction and its short direction along the arrow WH direction. One of the flanges 30B of the steel column 30 is joined to an upper end side of the first base plate 16C. Moreover, two first fixing holes, the first fixing hole 18A and the first fixing hole 18B that serve as first fixing portions are disposed on the first base plate 16C on the opposite side of the flange 30B to the web 30A side. First anchor bolts 24 serving as first anchor members are provided to the first fixing hole 18A and the first fixing hole 18B.

The second base plate 16D is configured in a rectangular flat plate shape with its length direction along the arrow FH direction and its short direction along the arrow WH direction. The second base plate 16D is provided at a separation to the first base plate 16C. The other of the flanges 30B of the steel column 30 is joined to an upper end side of the second base plate 16D. Two second fixing holes, the second fixing hole 20G and the second fixing hole 20H, are disposed on the second base plate 16D on the web 30A side of the flange 30B. Second anchor bolts 26 serving as second anchor members are provided to the second fixing hole 20G and the second fixing hole 20H.

Operation and Advantageous Effects of the Seventh Exemplary Embodiment

As illustrated in FIG. 11, the column structure 90 and the base member 16 according to the present exemplary embodiment, are provided with the first base plate 16C serving as the first base member that is joined to the one flange 30B of the steel column 30, and the second base plate 16D serving as the second base member that is joined to the other flange 30B of the steel column 30. The first base plate 16C and the second base plate 16D are configured at a separation to one another. The surface area of the base member 16 can thereby be reduced by the amount of the separation between the first base plate 16C and the second base plate 16D. In FIG. 11, the region enclosed by the by the broken line labelled 16E is omitted. A reduction in weight of the base member 16 equivalent to the region 16E can accordingly be achieved. Moreover, a reduction in the material required for manufacture of the base member 16 can be achieved. A reduction in the manufacturing costs of the column structure 90 and the base member 16 can also be achieved.

Moreover, in the column structure 90 and the base member 16 according to the present exemplary embodiment, a region 16B of the second base plate 16D on the opposite side of the flange 30B to the web 30A side is omitted, thereby enabling the steel column 30 to be brought closer to an adjacent boundary. Efficient utilization of the building site is thereby enabled.

Note that the present exemplary embodiment may be applied to any out of the column structure 10 and the base member 16 according to the first exemplary embodiment to the column structure 60 and the base member 16 according to the fourth exemplary embodiment. More specifically, for example in the column structure 10 and the base member 16 according to the first exemplary embodiment, the base plate 16A may be split into the first base plate 16C and a second base plate 16D.

Other Exemplary Embodiments

The present invention is not limited to the exemplary embodiments described above, and various modifications are possible within a range not departing from the spirit of the present invention. For example, in the first exemplary embodiment illustrated in FIG. 2, four fixing portions or anchor members are respectively provided to the base member along the flange width direction at both width direction end portions of the web. In the present invention, three or more fixing portions or anchor portions may be respectively provided to the one end portion and the other end portion in the base member length direction. When there are a minimum of three fixing portions or anchor members, one fixing portion or anchor member is provided at a flange width direction central portion, and one fixing portion or anchor member is provided at each flange width direction end portion. Moreover, when there are a minimum of three fixing portions or anchor members, configuration may be made such that two fixing portions or anchor members are provided at flange width direction central portions, and one fixing portion or anchor member is provided to one out of two flange width direction end portions. Moreover, in the present invention, one anchor member with high tensile strength may be provided at the building outside, or three or more anchor members may be provided.

The invention claimed is:

1. A column structure comprising:

a column member that is integrally provided with a flange at each of two width direction sides of a web;

a base member having an upper side joined to the column member;

a first anchor member including a lower end side that is fixed to a foundation, and including an upper end side to which the base member is fixed, the first anchor member being positioned:

at one width direction end side of the flange and not positioned at an end opposite to the one width direction end side of the flange; and a second anchor member including a lower end side that is fixed to the foundation, and including an upper end side to which the base member is fixed, the second anchor member being positioned:

at the other width direction end side of the flange, at which the first anchor member is not positioned and the second anchor member is not positioned at the one width direction end side of the flange at which the first anchor member is positioned, the second anchor member having higher tensile strength than the first anchor member, a third anchor member including a lower end side that is fixed to the foundation, and including an upper end side to which the base member is fixed, the third anchor member being positioned:

at one width direction end side of the web and not positioned at an end opposite to the one width direction end side of the web, a fourth anchor member including a lower end side that is fixed to the foundation, and including an upper end side to which the base member is fixed, the fourth anchor member being positioned:

at the other width direction end side of the web at which the third anchor member is not positioned and the fourth anchor member is not positioned at the one width direction end side of the web at which the third anchor member is positioned, the fourth anchor member having higher tensile strength than the third anchor member.

2. The column structure of claim 1, wherein a shaft diameter of the second anchor member is formed larger than a shaft diameter of the first anchor member.

3. The column structure of claim 1, wherein the second anchor member is formed from a material with higher tensile strength than the first anchor member material.

4. The column structure of claim 1, wherein the first anchor member and the second anchor member comprise multiple anchor members wherein there are a greater number of the second anchor member formed than that of the first anchor member.

5. The column structure of claim 1, wherein the first anchor member or the second anchor member comprises:

a first anchor bolt including an upper end side, to which the base member is fixed at the opposite side of the flange from the web side; and a second anchor bolt including an upper end side, to which the base member is fixed further toward the web width direction inside than the first anchor bolt, and that is disposed closer to the flange than the first anchor bolt.

6. The column structure of claim 1, wherein the first anchor member is disposed at the inside of a building, and the second anchor member is disposed at the outside of the building.

7. The column structure of claim 1, wherein the base member comprises:

a cutaway portion including a portion along the web that is cut away.

8. The column structure of claim 1, wherein the base member comprises:

a first base member having an upper side joined to one of the flanges, and that has the first anchor member upper end side fixed to the first base member; and a second base member having an upper side joined to the other of the flanges, and that is fixed to the second anchor member upper end side, the second base member being provided at a separation from the first base member.

9. A base member comprising:

a base body that has an upper side for joining to a column member integrally provided with a flange at each of two width direction sides of a web;

a first fixing portion that is fixed to an upper end side of a first anchor member, the first anchor member being provided to the base body, and being positioned:

at one width direction end side of the flange and not positioned at an end opposite to the one width direction end side of the flange, and including a lower end side that is fixed to a foundation; and a second fixing portion that is fixed to an upper end side of a second anchor member, the second anchor member being provided to the base body, and being positioned:

at the other width direction end side of the flange at which the first anchor member is not positioned and the second anchor member is not positioned at the one width direction end side of the flange at which the first anchor member is positioned, including a lower end side that is fixed to the foundation, and having higher tensile strength than the first anchor member, a third anchor member including a lower end side that is fixed to the foundation, and including an upper end side to which the base member is fixed, the third anchor member being positioned:

at one width direction end side of the web and not positioned at an end opposite to the one width direction end side of the web, a fourth anchor member including a lower end side that is fixed to the foundation, and including an upper end side to which the base member is fixed, the fourth anchor member being positioned:

at the other width direction end side of the web at which the third anchor member is not positioned and the fourth anchor member is not positioned at the one width direction end side of the web at which the third anchor member is positioned, the fourth anchor member having higher tensile strength than the third anchor member.

10. The base member of claim 9, wherein the base body comprises:

a cutaway portion including a portion along the web that is cut away.

11. The base member of claim 9, wherein the base body comprises:

a first base body having an upper side joined to one of the flanges, and that is fixed to the first anchor member upper end side; and a second base body having an upper side joined to the other of the flanges, and that is fixed to the second anchor member upper end side, with the second base body provided at a separation from the first base body.

12. A column structure comprising:

a column member that is integrally provided with a flange at each of two width direction sides of a web;

a base member having an upper side that is joined to the column member, a center position of the column member being offset in the web width direction, or in the flange width direction, with respect to a center position of the base member;

a first anchor member including a lower end side that is fixed to a foundation, and including an upper end side to which the base member is fixed at one width direction end side of the web; and a second anchor member including a lower end side that is fixed to the foundation, and including an upper end side to which the base member is fixed at the other width direction end side of the web, or at the other width direction end side the flange, the second anchor member having equivalent tensile strength to the first anchor member, wherein:

the first anchor member upper end side is fixed to the base member at the opposite side of the flange to the web side, and the second anchor member upper end side is fixed to the base member at the web side of the flange, and the base member comprises a first indented portion that is formed to the lower face of the base member at the position of the first anchor member and that opens away from the flange toward an outer periphery of the base member, and a second indented portion that is formed to the lower face of the base member at the position of the second anchor member and that opens away from the web toward an outer periphery of the base member, wherein the base member comprises:

a cutaway portion including a portion along the web that is cut away.

13. A column structure comprising:

a column member that is integrally provided with a flange at each of two width direction sides of a web;

a base member having an upper side that is joined to the column member, a center position of the column member being offset in the web width direction, or in the flange width direction, with respect to a center position of the base member;

a first anchor member including a lower end side that is fixed to a foundation, and including an upper end side to which the base member is fixed at one width direction end side of the web; and a second anchor member including a lower end side that is fixed to the foundation, and including an upper end side to which the base member is fixed at the other width direction end side of the web, or at the other width direction end side the flange, the second anchor member having equivalent tensile strength to the first anchor member, wherein:

the first anchor member upper end side is fixed to the base member at the opposite side of the flange to the web side, and the second anchor member upper end side is fixed to the base member at the web side of the flange, and the base member comprises a first indented portion that is formed to the lower face of the base member at the position of the first anchor member and that opens away from the flange toward an outer periphery of the base member, and a second indented portion that is formed to the lower face of the base member at the position of the second anchor member and that opens away from the web toward an outer periphery of the base member, wherein the base member comprises:

a first base member having an upper side joined to one of the flanges, and that has the first anchor member upper end side fixed to the first base member; and a second base member having an upper side joined to the other of the flanges, and that is fixed to the second anchor member upper end side, the second base member being provided at a separation from the first base member.

14. A base member comprising:

a base body that has an upper side for joining to a column member integrally provided with a flange at each of two width direction sides of a web, with a center position of the column member offset in the web width direction or in the flange width direction;

a first fixing portion that is fixed to an upper end side of a first anchor member, the first anchor member being provided to one web width direction end side of the base body and including a lower end side that is fixed to a foundation;

a second fixing portion that is fixed to an upper end side of a second anchor member, the second anchor member being provided at the web width direction other end side of the base body and including a lower end side that is fixed to the foundation, and having equivalent tensile strength to the first anchor member, wherein:

the first anchor member upper end side is fixed to the first fixing portion at the opposite side of the flange to the web side, and the second anchor member upper end side is fixed to the second fixing portion at the web side of the flange, and the base body comprises a first indented portion that is formed to the lower face of the base body at the position of the first anchor member and that opens away from the flange toward an outer periphery of the base body and a second indented portion that is formed to the lower face of the base body at the position of the second anchor member and that opens away from the web toward an outer periphery of the base body, wherein the base body comprises:

a cutaway portion including a portion along the web that is cut away.

15. A base member comprising:

a base body that has an upper side for joining to a column member integrally provided with a flange at each of two width direction sides of a web, with a center position of the column member offset in the web width direction or in the flange width direction;

a first fixing portion that is fixed to an upper end side of a first anchor member, the first anchor member being provided to one web width direction end side of the base body and including a lower end side that is fixed to a foundation;

a second fixing portion that is fixed to an upper end side of a second anchor member, the second anchor member being provided at the web width direction other end side of the base body and including a lower end side that is fixed to the foundation, and having equivalent tensile strength to the first anchor member, wherein:

the first anchor member upper end side is fixed to the first fixing portion at the opposite side of the flange to the web side, and the second anchor member upper end side is fixed to the second fixing portion at the web side of the flange, and the base body comprises a first indented portion that is formed to the lower face of the base body at the position of the first anchor member and that opens away from the flange toward an outer periphery of the base body and a second indented portion that is formed to the lower face of the base body at the position of the second anchor member and that opens away from the web toward an outer periphery of the base body, wherein the base body comprises:

a first base body having an upper side joined to one of the flanges, and that is fixed to the first anchor member upper end side; and a second base body having an upper side joined to the other of the flanges, and that is fixed to the second anchor member upper end side, with the second base body provided at a separation from the first base body.

* * * * *